US008918032B2

(12) United States Patent
Abler et al.

(10) Patent No.: US 8,918,032 B2
(45) **Date of Patent: *Dec. 23, 2014**

(54) VOLUMETRIC TONER CARTRIDGE HAVING TONER AGITATORS

(75) Inventors: Jeffrey Alan Abler, Georgetown, KY (US); Jonathan Murray Hill, Richmond, VA (US); Benjamin Erich Kant, Lexington, KY (US); Robert Watson McAlpine, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/617,785

(22) Filed: Sep. 14, 2012

(65) Prior Publication Data

US 2014/0079441 A1 Mar. 20, 2014

(51) Int. Cl.
*G03G 15/08* (2006.01)

(52) U.S. Cl.
CPC ..... *G03G 15/0839* (2013.01); *G03G 15/0832* (2013.01); *G03G 15/0837* (2013.01); *G03G 15/0834* (2013.01); *G03G 2215/0668* (2013.01); *G03G 2215/0692* (2013.01); *G03G 2215/0129* (2013.01)
USPC ..... 399/262

(58) Field of Classification Search
CPC ..... G03G 15/08
USPC ..... 399/262
See application file for complete search history.

(56) References Cited

U.S. PATENT DOCUMENTS

| | | | | |
|---|---|---|---|---|
| 3,946,910 | A * | 3/1976 | Case | 222/238 |
| 5,084,734 | A | 1/1992 | Yoshino et al. | |
| 5,331,388 | A | 7/1994 | Marotta et al. | |
| 5,425,481 | A * | 6/1995 | Makie et al. | 222/160 |
| 6,266,505 | B1 * | 7/2001 | Ban et al. | 399/258 |
| 6,594,458 | B2 * | 7/2003 | Ban et al. | 399/106 |
| 6,792,228 | B2 * | 9/2004 | Ban et al. | 399/106 |
| 6,853,828 | B2 * | 2/2005 | Ban et al. | 399/258 |
| 6,968,139 | B2 * | 11/2005 | Ban et al. | 399/106 |

(Continued)

FOREIGN PATENT DOCUMENTS

JP 2006-011273 * 1/2006 ..... G03G 15/00

OTHER PUBLICATIONS

U.S. Appl. No. 13/617,521, filed Sep. 14, 2012.
U.S. Appl. No. 13/617,603, filed Sep. 14, 2012.

(Continued)

*Primary Examiner* — Clayton E Laballe
*Assistant Examiner* — Kevin Butler
(74) *Attorney, Agent, or Firm* — John Victor Pezdek

(57) ABSTRACT

A toner cartridge for an imaging device having a housing having a toner reservoir and an exit port in fluid communication with the toner reservoir. A drive shaft rotatably mounts within the toner reservoir. A toner platform is movably coupled to the drive shaft and is nonrotatable but slidable relative to the housing. A resilient arm is positioned within the reservoir and biased toward an initial position in the path of the toner platform. When the drive shaft rotates, the toner platform translates toward the exit port. When the toner platform contacts the resilient arm, the resilient arm moves to permit the toner platform to pass and when the toner platform moves further toward the exit port the resilient arm returns to the initial position. The resilient arm may mount on the inner surface, the toner to platform or the drive shaft.

18 Claims, 15 Drawing Sheets

(56) References Cited

U.S. PATENT DOCUMENTS

| | | | | |
|---|---|---|---|---|
| 6,978,101 | B2 * | 12/2005 | Ban et al. | 399/106 |
| 7,386,250 | B2 * | 6/2008 | Ban et al. | 399/106 |
| 7,606,520 | B2 * | 10/2009 | Dawson | 399/260 |
| 8,649,710 | B2 * | 2/2014 | Buchanan et al. | 399/258 |
| 2001/0008590 | A1 * | 7/2001 | Katada et al. | 399/167 |
| 2005/0169672 | A1 * | 8/2005 | Ban et al. | 399/258 |
| 2007/0172252 | A1 | 7/2007 | Koyama et al. | |
| 2008/0138113 | A1 * | 6/2008 | Murrell et al. | 399/167 |
| 2013/0170868 | A1 * | 7/2013 | Acosta et al. | 399/258 |

OTHER PUBLICATIONS

U.S. Appl. No. 13/617,682, filed Sep. 14, 2012.

Ex Parte Quayle Action dated Jul. 10, 2014 for U.S. Appl. No. 13/617,682.

Non-Final Office Action dated Sep. 8, 2014 for U.S. Appl. No. 13/617,521.

Notice of Allowance dated Sep. 18, 2014 for U.S. Appl. No. 13/617,603.

Notice of Allowance dated Sep. 5, 2014 for U.S. Appl. No. 13/617,682.

* cited by examiner

VOLUMETRIC TONER CARTRIDGE HAVING TONER AGITATORS

CROSS REFERENCES TO RELATED APPLICATIONS

This patent application is related to the U.S. patent application Ser. No. 13/617,521, filed Sep. 14, 2012, entitled "Volumetric Toner Cartridge Having Driven Toner Platform" and assigned to the assignee of the present application.

This patent application is related to the U.S. patent application Ser. No. 13/617,603, filed Sep. 14, 2012, entitled "Volumetric Toner Cartridge Having Driven Detachable Toner Platform" and assigned to the assignee of the present application.

This patent application is related to the U.S. patent application Ser. No. 13/617,682, filed Sep. 14, 2012, entitled "Volumetric Toner Cartridge Having Removable Exit Paddle" and assigned to the assignee of the present application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to toner cartridges used in electrophotographic imaging devices such as printers or multifunction devices having printing capability and more particularly to a volumetric toner cartridge having a driven platform.

2. Description of the Related Art

In toner cartridge design, it is now common practice to separate the longer lived components from those having a shorter life. This has lead to having the longer lived developing components, such as the developer roll, toner adder roll, doctor blade, the foregoing are also referred to as a developing unit, photoconductive drum, cleaning and charge rollers and a waste bin, to be in separate assemblies from the toner cartridge. The toner supply, which is consumed relatively quickly in comparison to the previously described components, is provided in a reservoir in a separate toner cartridge that mates with the developer unit. The toner cartridge has a reduced number of components and is often to referred to as a toner bottle even though it is more than a mere bottle for holding toner.

To deliver the toner from the toner cartridge to the developer unit, an auger in the toner cartridge may be used to feed toner from the toner cartridge via an exit port on the toner cartridge into an entry port on the developer unit and into a second auger that disperses the toner within the developer unit. As the toner is drawn out of the cartridge unit, it is augured through a shutter used for sealing the exit port of the toner cartridge when it is not inserted in the imaging apparatus.

While moving toner through the restriction formed by the shutter, auger and exit port, the opening from the exit port into the toner reservoir in the toner cartridge is relatively air tight. A low pressure condition or vacuum-like condition is created in the toner cartridge as toner is removed, as air cannot enter to fill the void. If the toner cartridge were viewed as being a pump supplying toner from the toner reservoir, this low pressure condition would be analogous to cavitation in a pump. The number of rotations of the auger is used to estimate toner delivery from the toner cartridge. However, low flow due to the discussed pressure differential may lead to inaccuracies in using this approach.

It would be advantageous to have a toner feeding system that provides for more accurate toner delivery and helps to avoid a number of previously mentioned toner delivery failures.

SUMMARY

A toner cartridge for an electrophotographic imaging device having a housing with two opposed end walls, an elongated body therebetween and an exit port. The body has an inner surface defining a toner reservoir for containing a quantity of toner. The toner reservoir is in fluid communication with the exit port. A drive shaft rotatably mounts within the toner reservoir. A toner platform having a front surface, a rear surface and an edge surface is movably coupled to the drive shaft and is nonrotatable but slidable relative to the housing. The front surface moves toner within the reservoir toward the exit port. A resilient arm is positioned within the reservoir and biased toward an initial position in the path of the toner platform. When the drive shaft rotates, the toner platform translates toward the exit port for moving toner within the reservoir toward the exit port. When the toner platform contacts the resilient arm, the resilient arm moves out of the path of the toner platform to to permit the toner platform to pass and when the toner platform moves further toward the exit port the resilient arm returns to the initial position.

In one form the resilient arm mounts on the inner surface and the inner surface has a recess positioned to receive the resilient arm when the toner platform contacts the resilient arm. In another form the resilient arm mounts on the toner platform and the inner surface has a recess positioned to receive the resilient arm when the toner platform contacts the resilient arm. In a further form, the resilient arm mounts on the drive shaft and the drive shaft includes a recess positioned to receive the resilient arm when the toner platform contacts the resilient arm. The resilient arm may be pivotally mounted in the recess of the drive shaft and cantilevered outward from the drive shaft in the initial position.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIG. 5 shows a semi-circular-rectangular housing shape, FIG. 6 shows a semi-circular, irregular rectangular housing shape, and FIG. 7 shows a generally circular housing shape.

FIG. 9 shows a plurality of radial arms having radial wipers while FIGS. 10-12 illustrate various circumferential arm extension arrangements.

FIG. 14 shows an o-ring seal, FIG. 15 shows a single overmolded rib seal, and FIG. 16 shows dual overmolded rib seals.

DETAILED DESCRIPTION

Figure 1:
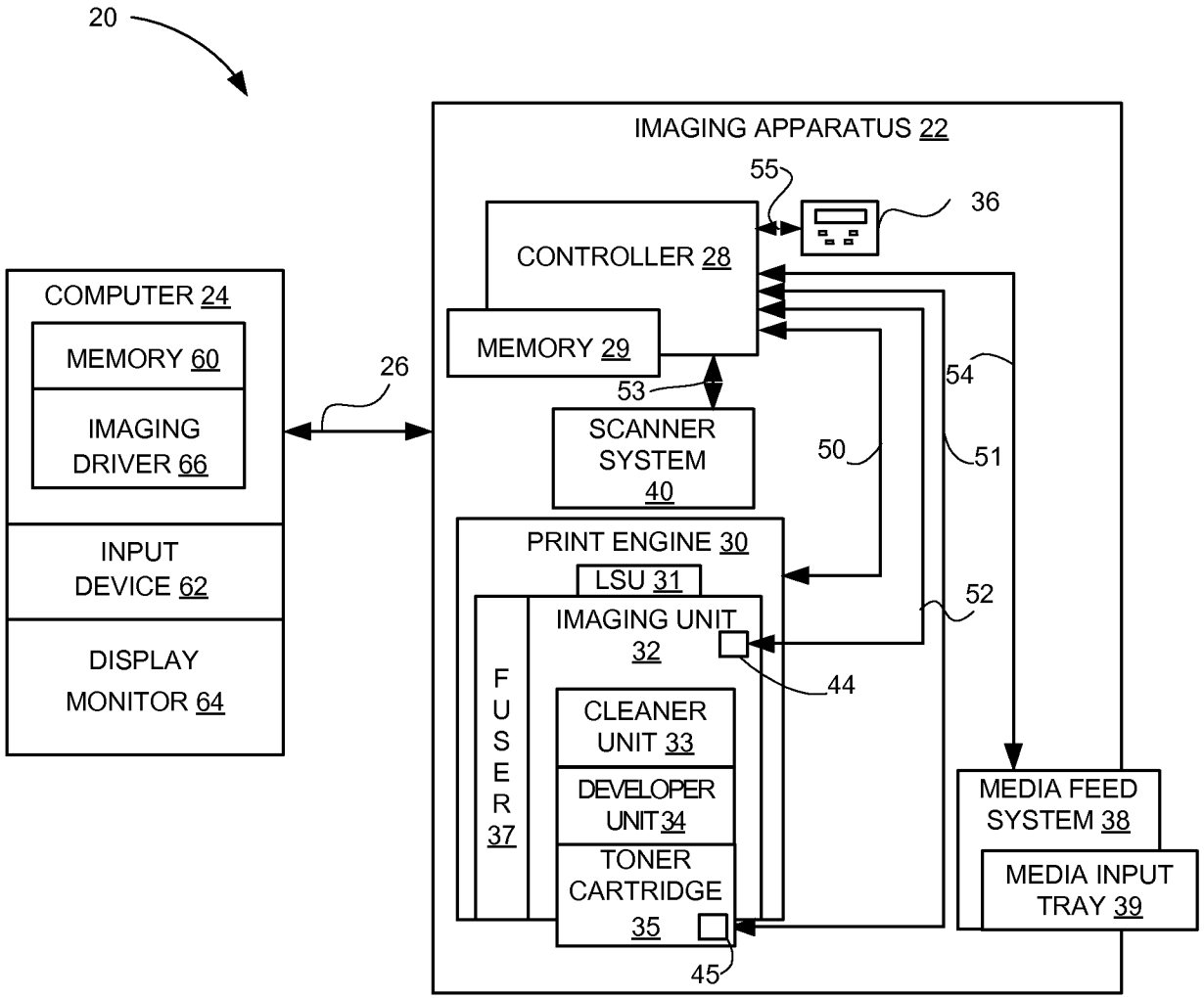
FIG. 1 is a block diagram of an example imaging system utilizing the toner cartridge of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "under", "below", "lower", "over", "upper", and the like, are used for ease of description to explain the relative positioning of one element to a second element. Terms like "horizontal" and "vertical" are used in a similar relative positioning as illustrated in the figures. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description. The articles "a", "an" and "the" are intended to include the plural as well as the singular, unless the context clearly indicates otherwise.

The term "image" as used herein encompasses any printed or digital form of text, graphic, or combination thereof. The term "output", as used herein, encompasses output from any printing device such as color and black-and-white copiers, color and black-and-white printers, and so-called "all-in-one devices" that incorporate multiple functions such as scanning, copying, and printing capabilities in one device. The term "button" as used herein means any component, whether a physical component or graphic user interface icon, that is engaged to initiate output.

Referring now to the drawings and particularly to FIG. 1, there is shown a diagrammatic depiction of an imaging system 20 embodying the present invention. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32 having a cleaner unit 33 and a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone printer.

Controller 28 includes a processor unit and associated memory 29, and may be formed as one or more Application Specific Integrated Circuits (ASICs). Memory 29 may be any volatile or non-volatile memory or combinations thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 52. Controller 28 communicates with toner cartridge 35 and processing circuitry 45 therein via a communications link 51. Controller 28 communicates with media feed system 38 via a communications link 54. Controller 28 communicates with scanner system 40 via a communications link 53. User interface 36 is communicatively coupled to controller 28 via a communications link 55. Processing circuits 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, network server, tablet computer, smartphone or other hand-held electronic device, including memory 60, such as volatile and/or non-volatile memory, input device 62, such as a keyboard, and a display, such as monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include a laser scan unit (LSU) 31, an imaging unit 32, a toner cartridge 35, and a fuser 37, all mounting within imaging apparatus 22. The imaging unit 32 further includes a cleaner unit 33 housing a waste toner removal system and a photoconductive drum, and a developer unit 34 that are removably mounted within imaging unit 32. In one embodiment the cleaner unit 33 and developer unit 34 are assembled together and installed into a frame forming the imaging unit 32. The toner cartridge 35 is then installed in the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

The toner cartridge 35 removably mates with the developer unit 34 in imaging unit 32. An exit port on the toner cartridge 35 communicates with an inlet port on the developer unit 34 allowing toner to be periodically transferred from the toner cartridge 35 to resupply the toner sump in the developer unit 34.

Figure 2:
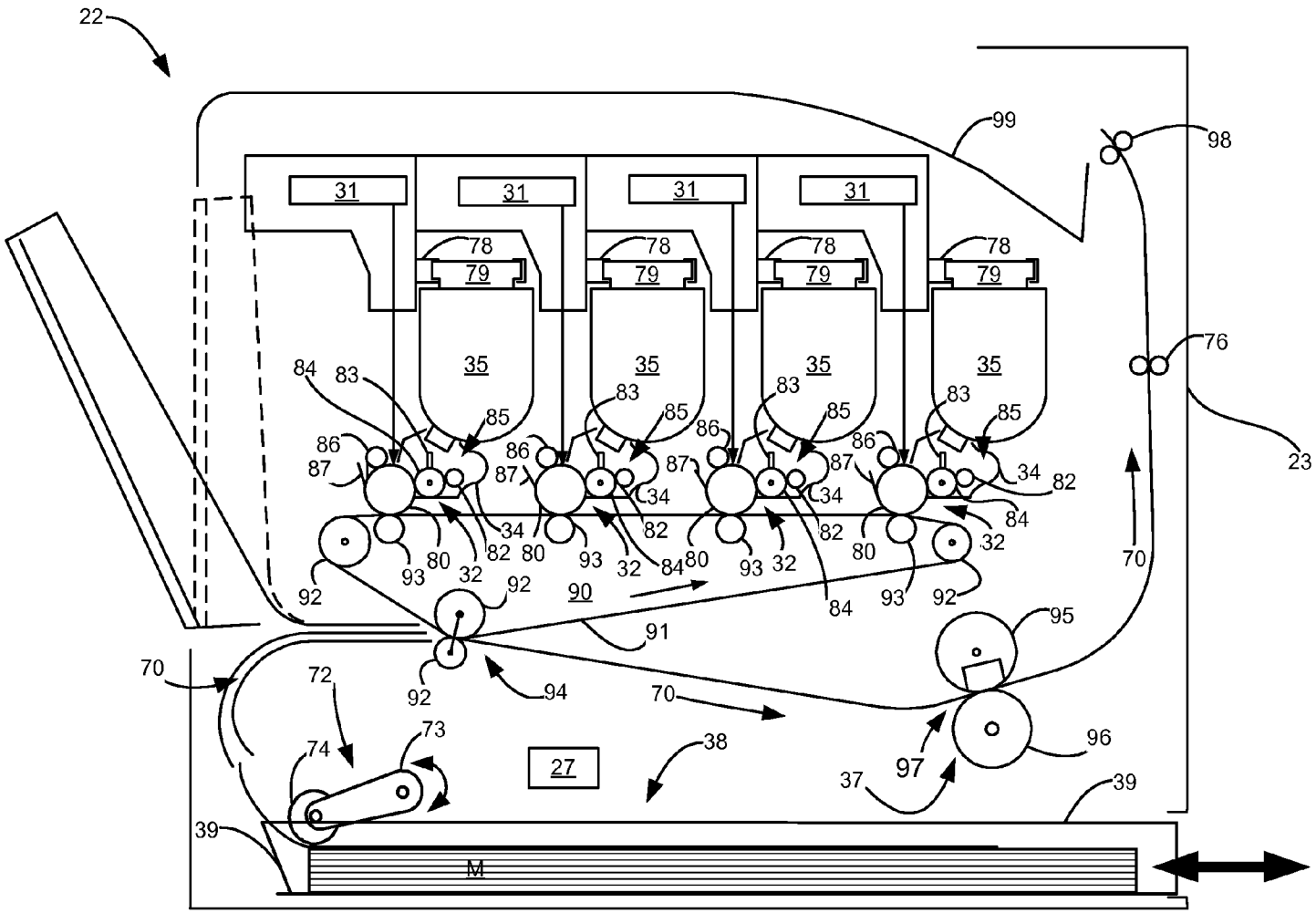
FIG. 2 is an illustration of one example embodiment of a color imaging apparatus.

Referring now to FIG. 2, an example embodiment of a color image apparatus 22 is shown. A media path 70 extends through the imaging apparatus 22 for moving the media sheets through the imaging process. A media sheet is initially introduced into the media path 70 by a pick mechanism 72 of the media feed system 38 from the media input tray 39, which is indicated by the double headed arrow as being removably insertable into a housing 23 of imaging apparatus 22. In the exemplary embodiment shown, the pick mechanism 72 comprises a pivotable arm 73 having a roll 74 positioned at one end of the arm 73. The roll 74 rotates to move the topmost media sheet from the media stack M in the media input tray 39 and into the media path 70. The media sheet is then moved along the media to path 70 by one or more pairs of transport rollers 76.

The imaging apparatus 22 includes one or more imaging units 32 mounted within housing 23. In some embodiments, the toner cartridge 35 and the imaging unit 32 comprise a single unit. Alternatives include those wherein the toner cartridge 35 and the imaging unit 32 comprise multiple units that are operatively connected to one another. Each of the imaging units 32 is mounted such that photoconductor (PC) drums 80 of the imaging units 32 are substantially parallel. In one embodiment, each of the imaging units 32 is substantially the same except for the color of toner stored and transferred. The toner cartridges 35 are shown being horizontally inserted into a frame 78 using one or more guide rails 79 provided, as illustrated, on the top of each toner cartridge 35. It should be realized that the mounting orientation of the toner cartridges 35 can be other than horizontal. The toner cartridges 35 can be vertically inserted or inserted at any angle between horizontal and vertical and its mounting orientation is not critical. When mounted in a non-horizontal orientation the exit port would normally be lower than the bulk of the cartridge to allow gravity to encourage toner flow. However, the present form of the toner cartridge would also allow the exit port to be at a higher position than the bulk of the toner cartridge.

The developer unit 34 in one example embodiment includes a toner adder roll 82, a doctor blade 83 and a developer roll 84 and a sump 85 for toner. The toner adder roll 82 coats the developer roll 84 with toner while electrostatically charging the toner particles. As the toner is placed on the developer roll 84, the doctor blade 83 evens the toner to a predetermined thickness. In one embodiment, the toner sumps 85 each contain one of black, magenta, cyan, or yellow toner. In one embodiment, each of the toner sumps 85 is substantially the same. In another embodiment, the toner sumps 85 include different capacities.

Each imaging unit 32 further includes a charging roll 86 and a cleaning blade 87. PC drum 80, charging roll 86, and cleaning blade 87 can be housed in the cleaner unit 33. The charging roll 86 forms a nip with PC drum 80 and charges the surface of PC drum 80 to a specified voltage. A laser beam, as indicated by the vertical arrow, from a LSU 31 is directed to the surface of the PC drum 80 and discharges those areas it contacts to form a latent image. The developer roll 84, which also forms a nip with the PC drum 80, then transfers toner to the PC drum 80 to form a toner image. The toner is attracted to the areas of the surface of PC drum 80 discharged by the laser beam. The cleaning blade 87 then removes any remaining particles of toner from the PC drum 80 after the toner image is transferred to either the media or an intermediate transfer mechanism.

In the embodiment shown in FIG. 2, an intermediate transfer mechanism (ITM) 90 is disposed adjacent to each of the imaging units 32. In this embodiment, the ITM 90 is formed as an endless belt 91 trained about a series of rollers 92. During image forming operations, the belt 91 moves past the imaging units 32 as viewed in FIG. 2. One or more of the PC drums 80 apply toner images in their respective colors to the belt 90. In one embodiment, toner transfer rollers 93 positioned beneath belt 90 adjacent each PC drum 80 provide a positive voltage field that attracts the toner image from the PC drums 80 to the surface of moving belt 91. As ITM 90 revolves, belt 91 collects the one or more toner images from the imaging units 32 at a first transfer area beneath each of the imaging units 32 and then conveys the toner images to a media sheet at a second transfer area. The second transfer area includes a transfer nip 94 formed between a pair of rollers 92. Alternative embodiments include those wherein the toner images are applied directly to the media sheet by the PC drum(s) 80.

After receiving the toner images, the media sheets are moved further along the media path 70 and into a fuser 37. The fuser 37 includes a fusing roll 95, or belt, and a backup roll 96 that form a fuser nip 97 to apply pressure and/or heat to the toner image on the media sheet as it passes through the fuser nip 97. The combination of heat and/or pressure fuses or adheres the toner image to the media sheet. The fused media sheet then passes through exit rolls 98 located downstream from the fuser 37 and into an output bin 99 or through a duplex path (not shown) for duplex printing.

In the embodiment illustrated, the imaging apparatus 22 is a color laser printer. In another embodiment, the imaging apparatus 22 is a mono printer comprising a single toner cartridge 35 and a single imaging unit 32 for forming toner images in a single color. In another embodiment, the imaging apparatus 22 is a direct transfer device that transfers the toner images from the one or more PC drums 80 directly to the media sheet. As used herein, the term media sheet is meant to encompass not only paper but also labels, envelopes, fabrics, photographic paper or any other desired substrate that can receive a toner image.

Controller 28 oversees the functioning of the imaging apparatus 22 including movement of the media along media path 70, imaging unit(s) 32, ITM 90, laser scan units 31, and user interface 36. Each toner cartridge 35 and/or imaging unit 32 may also contain its own associated memory as discussed above.

The imaging apparatus 22 includes various consumable items that must be replaced at various times over the life of the imaging apparatus 22. These may include, but are not limited to, for example, each PC drum 80, each toner cartridge 35 and/or the toner stored therein, each toner adder roll 82, each doctor blade 83, each developer roll 84, each charging roll 86 and each cleaner blade 87. The imaging apparatus 22 also includes one or more gauges for tracking the remaining life of one or more of these consumable items. For example, the imaging apparatus 22 can include a toner gauge that estimates and tracks the amount of toner remaining in one or more toner cartridges 35. In those embodiments that contain multiple toner cartridges 35 and imaging units 32, the imaging apparatus 22 can include a separate gauge for each respective consumable item. For example, the imaging apparatus 22 can include separate gauges for the amounts of black, cyan, yellow and magenta toner remaining and/or for the PC drums 80 associated with each imaging unit 32.

Figure 3:
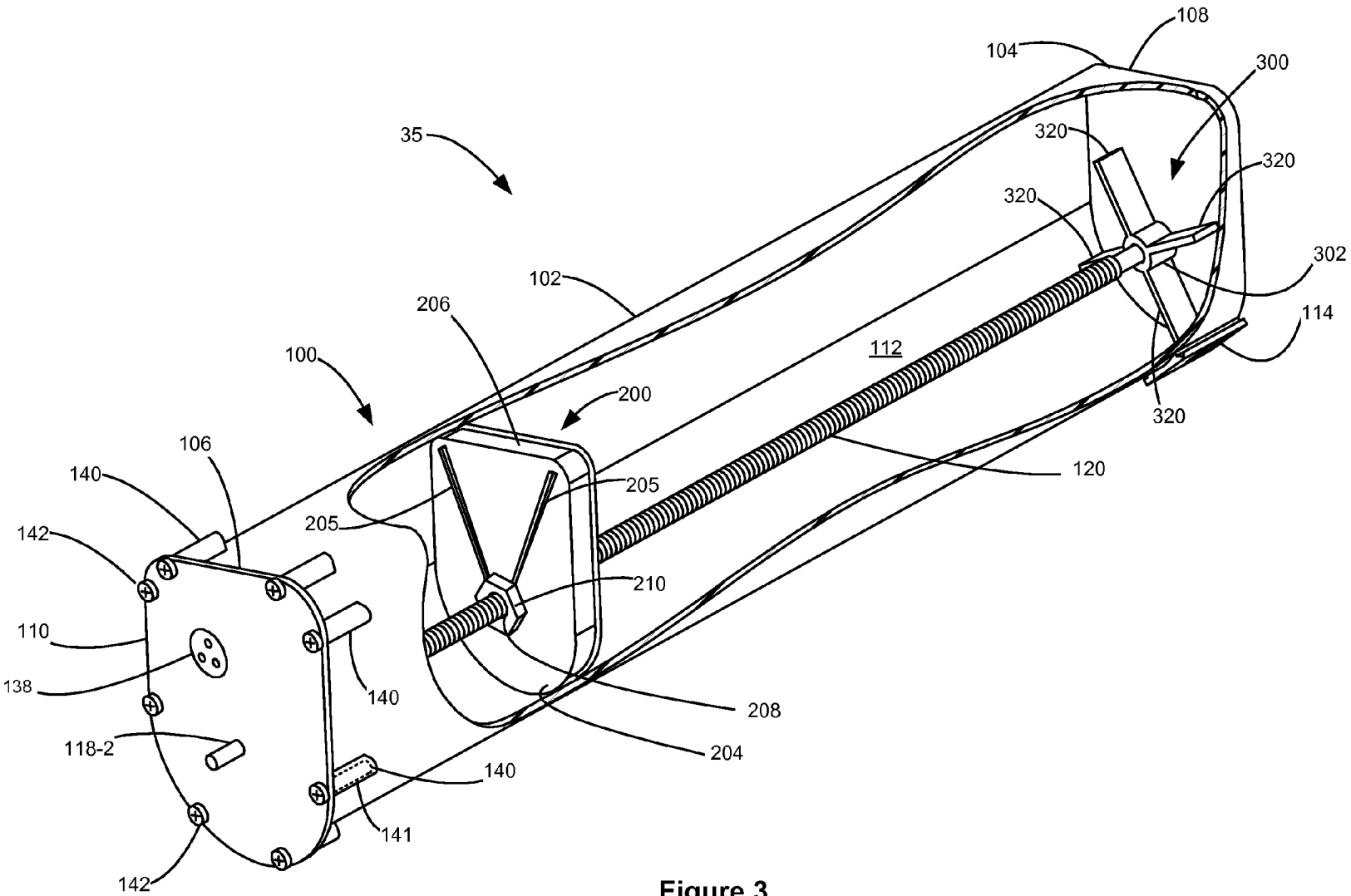
FIG. 3 is a cutaway illustration of the toner cartridge according to one example embodiment.
Figure 4:
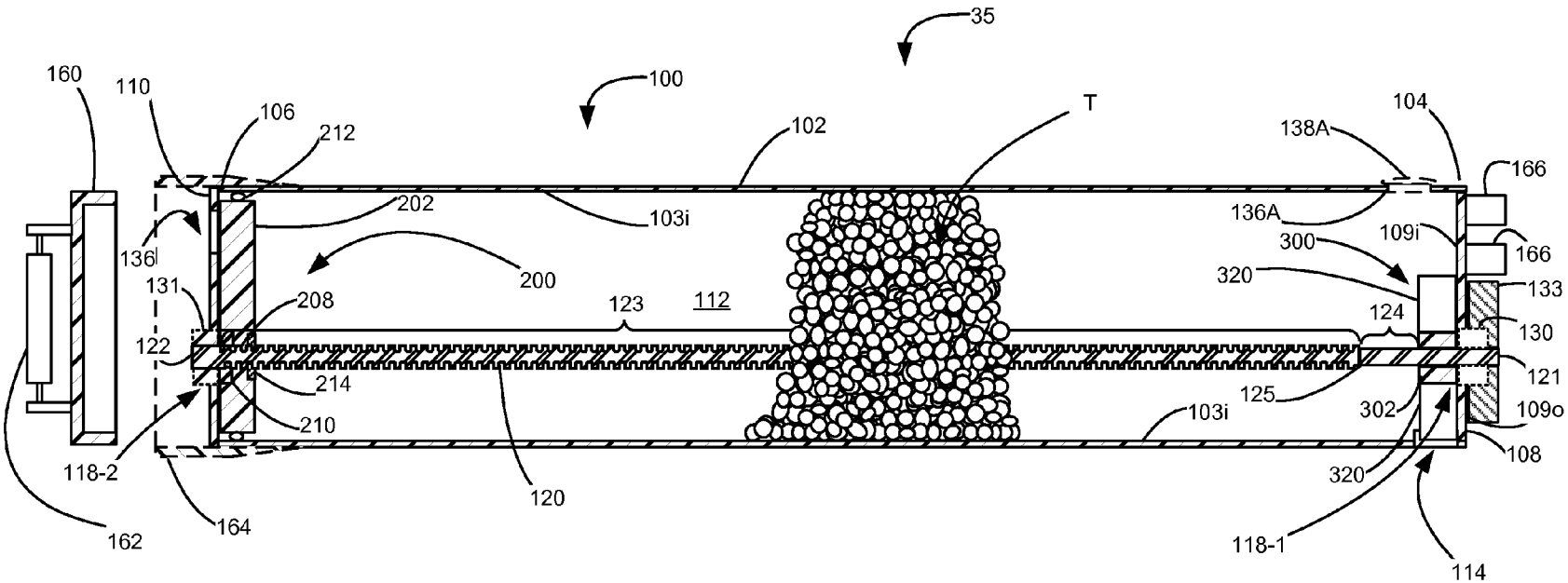
FIG. 4 is a sectional illustration of the toner cartridge including an end cap according to one example embodiment.

Referring now to FIGS. 3 and 4, an example toner cartridge 35 is shown. Toner cartridge 35 is comprised of a housing 100 having a body 102 with first and second ends 104, 106. Body 102 may be termed "tubular" or "elongate" and have various shapes as described herein. Enclosing each of ends 104, 106 are first and second end walls 108, 110, respectively forming toner reservoir 112 for containing toner T. An exit port 114 is shown provided on a lower portion of body 102 near one of the ends, end 104 as illustrated. Exit port 114 is in communication with toner reservoir 112 to allow toner to be delivered from the toner reservoir 112 to the developer unit 34 and toner sump 85. As is well understood to a person of ordinary skill in the art, a shutter (not shown) can be provided on exit port 114 to provide added sealing of the exit port 114 when toner cartridge 35 is not installed in imaging apparatus 22.

Aligned openings 118-1, 118-2 are provided in end walls 108, 110. A drive shaft 120 extends the length of the body 102 with first and second ends 121, 122 thereof extending through end walls 108, 110, respectively. Drive shaft 120 has a threaded portion 123 and an unthreaded portion 124 that meet at a junction 125. Unthreaded portion 124 is shown having a slightly smaller diameter than threaded portion 123. Coupled to drive shaft 120 is a drive coupler 133, a toner platform 200 and an exit paddle 300. As illustrated, drive coupler 133 is attached to first end 121 of drive shaft 120 and, when cartridge 35 is inserted into imaging apparatus 22, drive coupler 133 removably engages with a drive mechanism (not shown) provided within imaging apparatus 22 to receive rotational force. First end 104 of body 102 may also be termed the drive end of toner cartridge 35 while second end 106 of body 102 may be termed the non-drive end of toner cartridge 35. The size and configuration of drive coupler 133 is a matter of design choice and may include a gear or gear train or a coupler such as an Oldham coupler as is known in the art. First and second bearings 130, 131, if provided, may be mounted in aligned openings 118-1, 118-2 in end walls 108, 110 about first and second ends 121, 122, respectively, of drive shaft 120. End walls 108 and 110 may be fabricated from a bearing-grade plastic obviating the need for separate bearings. One or both bearings 130, 131, may be a clutched bearing to provide for uni-directional rotation of drive shaft 120, if desired.

An end cap, such as end cap 160 as shown in FIG. 4, may be provided on the non-drive end 106 of housing 100. End cap 160 may have a handle, such as handle 162 to assist the user during insertion or removal of cartridge 35 from imaging apparatus 22. End cap 160 may be attached using threaded fasteners to mounting lugs 140 or may be ultrasonically welded to a circumferential flange such as flange 164. When provided, flange 164 forms a recess in which end wall 110 is mounted. One or more keying features 166 may be provided on toner cartridge 35. As shown in FIG. 4, keying features 166 are provided on an external surface of first end wall 108. One or more keying features 166 are used to provide information about the toner cartridge 35 to the imaging apparatus 22. This information may include the color of the toner contained within toner reservoir 112 and these keying features 166 allow only the correct color of toner cartridge 35 to be inserted into its proper position within imaging apparatus 22.

A vent hole 136 may be provided in one or both of the end walls 108, 110, such as end wall 110 as illustrated, or in body 102 as shown by hole 136A to allow pressure equalization or to prevent cavitation that may lead to toner starvation that may occur during feeding of toner from toner reservoir 112. Vent holes 136, 136A can be covered by vent caps 138, 138A, respectively that snap fit or screw into vent holes 136, 136A. Vent caps 138, 138A can be a labyrinth style cap or can be formed of a filter or foam material that is inserted into vent holes 136, 136A or is applied to the outer surface of the end walls 108, 110 or body 102. The type and attachment of vent caps 138, 138A is a matter of design choice.

As illustrated with end wall 110 (see FIG. 3), body 102 may be provided with a plurality of mounting lugs 140 each having a hole 141 therein for receiving screws 142 used to mount the end walls. Alternately, the end walls 108, 110 may be ultrasonically welded or glued to the ends 104, 106, respectively of body 102 as illustrated in FIG. 4. In a further form, one of end walls 108, 110 may be integrally formed with body 102 as a unitary structure forming a closed ended tubular structure. So while the housing 100 is described as having two end walls 108, 110, one of those walls may be formed integrally with body 102.

The toner platform 200 includes a front surface 202 that is used to push the toner within the reservoir 112 toward the exit port 114, a rear surface 204, and an edge surface 206 interconnecting the front and rear surfaces 202, 204. Based on design choice, toner platform 200 may be a solid or hollow structure. The front surface 202 of toner platform 200 is generally smooth and planar and is generally orthogonal to the axis of rotation of drive shaft 120. The rear surface 204 of toner platform can also be generally planar but it may also comprise one or more ribs 205 for stiffening the front surface 202. The number, pattern, and shape of the ribs 205 are a matter of design choice. One of skill in the art will recognize that other shapes, including non-planar, angled or curvilinear shapes, may be used for the front surface 202 and rear surface 204 and that the shapes of the front surface 202 and rear surface 204 can be different from each other. Drive shaft 120 is inserted through opening 208 provided in toner platform 200. A coupling 210 is mounted in or on toner platform 200 about opening 208 to movably couple toner platform 200 to drive shaft 120. A drive shaft seal 214 may be provided in or on front surface 202 to minimize toner leaking through opening 208 of toner platform 200 as it is driven toward the exit port 114. Drive shaft seal 214 may be made of an elastomeric or foam material. Toner platform 200 travels along the threaded portion 123 while the drive shaft 120 is rotated during toner feeding. One form of coupling 210 is a traveling nut such as threaded nut 210 provided on either the front surface 202 or rear surface 204 (when viewed in the direction of travel of the toner platform 200 toward exit port 114). Drive shaft 120 may be rotated in a first direction to cause toner platform 200 to move toward the exit port 114. Drive shaft 120 may be rotated in a second direction to move toner platform 200 toward second end wall 110.

It should be noted that the toner platform 200 is termed herein as being "nonrotatable" with respect to the housing 102 or toner reservoir 112 so that it will translate within the toner reservoir 112 when the drive shaft 120 is rotated. In actuality, the nonrotatable toner platform 200 will rotate a minor amount because of gap between the inner surface 103*i* of body 102 and the toner platform 200 allowing the toner platform 200 to rotate slightly when the drive shaft 120 begins rotating. This slight movement is due to the friction between the coupling 210 and the drive shaft 120 (See FIGS. 31-32). The toner platform stops 200 rotating when it contacts the inner surface 103*i*. Thereafter, the toner platform will translate along drive shaft 120.

Figure 24:
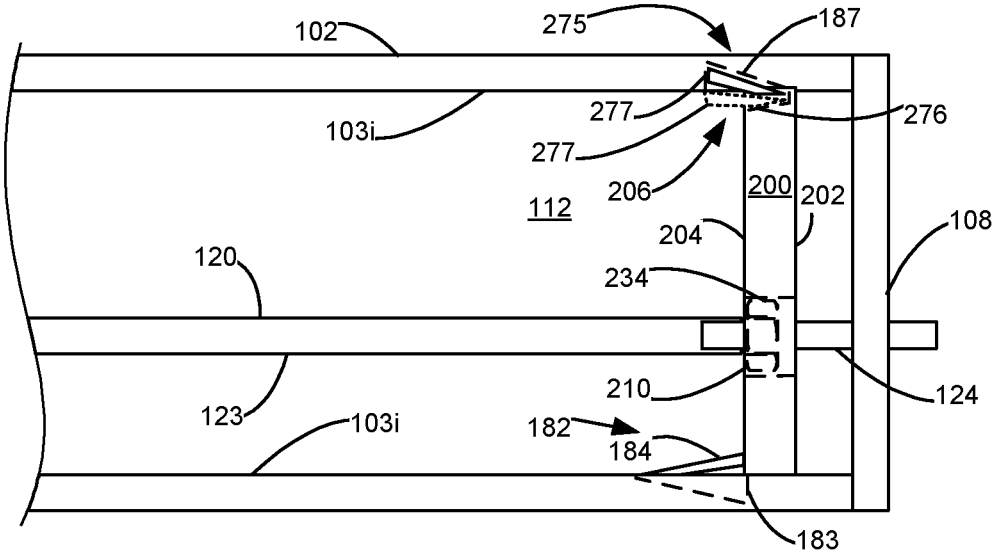
FIG. 24 is a simplified schematic view that illustrates the latching system of FIGS. 21-23 but provided on the toner platform.

A front recess 230 (see FIG. 20), or a rear recess 232 (see FIG. 8), either of which can extend through toner platform 200, can be provided in toner platform 200. In FIG. 24, a recess 234 is in the form of a through hole 234 in toner platform 200. Each recess 230, 232, 234 is sized to hold drive nut 210 about opening 208 and to prevent its rotation relative to toner platform 200. Drive nut 210 can be press-fit into recesses 230, 232, 234, be made to adhere to toner platform 200 about opening 208 or attached using other fastening techniques.

Figure 5:
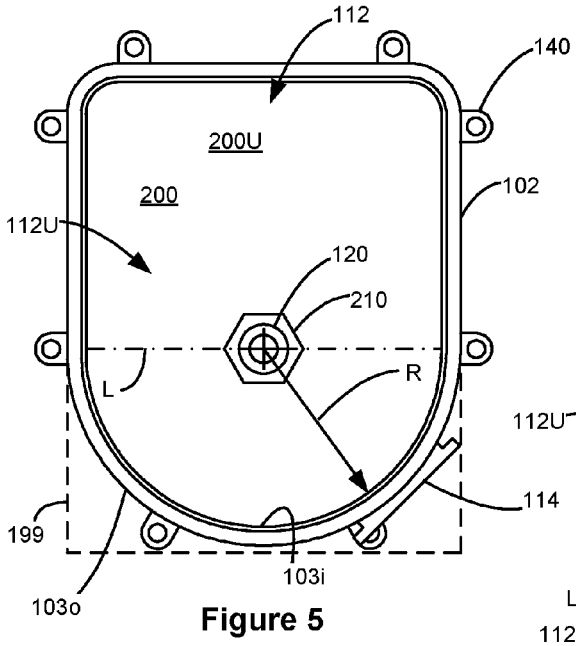
FIGS. 5-7 are simplified schematic depictions of the toner cartridge illustrating different housing shapes where
Figure 6:
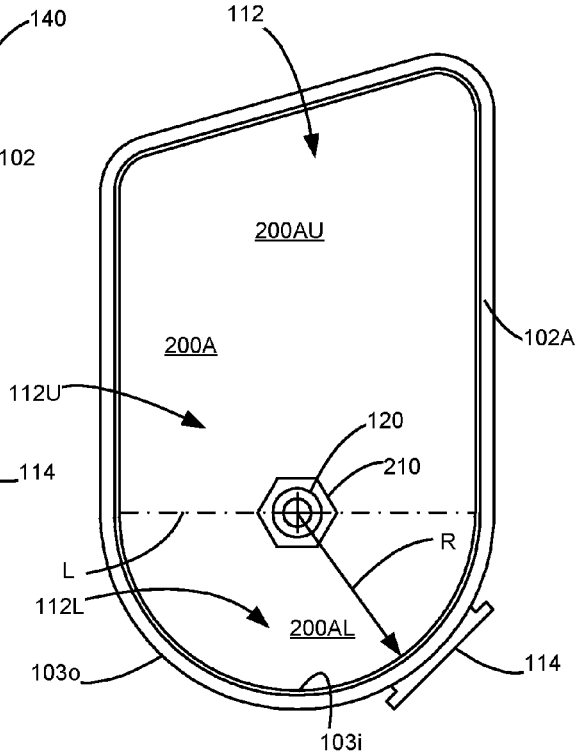
Figure 7:
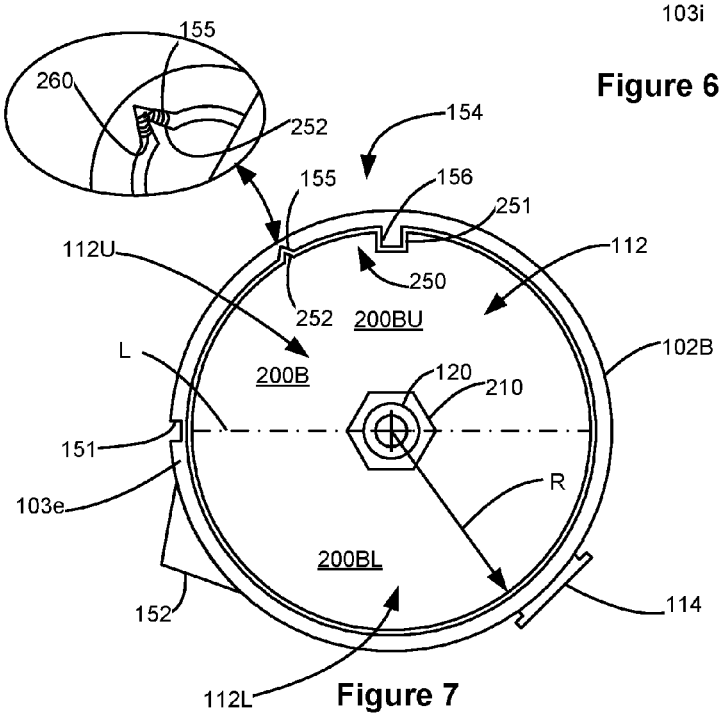

Various shapes as illustrated in FIGS. 5-7 may be used for toner platform 200, toner reservoir 112, and the body 102 of housing 100. The edge surface 206 or outer perimeter of toner platform 200 is shaped to closely conform to the cross-sectional shape of toner reservoir 112 in body 102 while still being able to travel within toner reservoir 112. This is done to minimize toner leakage around toner platform 200. For purposes of describing the cross-section shapes of body 102 and toner reservoir 112 of housing 100, a horizontal reference line L is shown positioned through the center of drive shaft 120 to arbitrarily divide toner reservoir 112 into an upper toner reservoir 112U and a lower toner reservoir 112L.

As shown in FIGS. 5-7, the respective volume shape of lower reservoirs 112L of bodies 102, 102A, 102B may be described as half-cylinders having a radius of curvature R sized to accommodate the diameter of exit paddle 300. Other shapes for lower reservoirs 112L can be used such as those shapes shown for upper toner reservoirs 112U. In other words the overall shape of reservoir 112 may be a cuboid or trapezium in shape similar to the shapes illustrated for upper reservoirs 112U of bodies 102, 102A. The outer surface of bodies 102, 102A, 102B are shown having a similar shape to that of lower toner reservoir 112L and upper reservoir 112U.

The respective upper reservoirs 112U of bodies 102, 102A, 102B differ in volumetric shape from one another. The volume shape of upper reservoir 112U of body 102 may be termed a rectangular prism or a cuboid, upper reservoir 112U of body 102A termed a trapezium, and upper reservoir 112U of body 102B termed a half-cylinder. Various combinations of shapes can be used for the upper and lower reservoirs.

It will be realized that the configuration of outer surface 103*e* of body 102 can be made to vary from that of its inner surface 103*i*. For example, the lower toner reservoir 112L of body 102 is shown in FIG. 5 by dashed lines 199 as having a rectangular or cuboid form while the inner surface or wall of the lower reservoir 112L of body 102 remains semi-cylindrical. Similar modifications and other shape types may be applied to the outer surfaces 103*e* of bodies 102A, 102B.

As can be seen, the shapes of bodies 102, 102A are self orientating when inserted into imaging apparatus 22. For example, assuming a horizontal operating position for toner cartridge 35, the upper flat portion of body 102 and the upper angled portion of body 102A would be recognized by a user as their respective tops. Body 102B, however, is circular and accordingly is provided with external orienting features 150 such as a keyway 151 and/or a key 152 on its outer surface 103*e*. Similarly, toner platform 200B is also provided with one or more orienting features 250 such as keyway 251 and/or key 252 with corresponding internal orienting features 154 on the inner surface of body 102B such as keyway 155 or key 156. As shown in the inset provided in FIG. 7, sealing material 260 can be provided in keyway 155 or on key 252 to mitigate toner leakage through the gap therebetween or the gap between key 156 and keyway 251.

The lower portions 200L, 200AL, 200BL of platforms 200, 200A, 200B, respectively, are shaped to conform to the shape of lower reservoirs 112L of bodies 102, 102A, 102B, respectively. The upper portions 200U, 200AU, 200BU of platforms 200, 200A, 200B, respectively, are similarly shaped to conform to the shape of upper reservoir 112U of bodies 102, 102A, 102B, respectively. As shown in FIGS. 5 and 6, the drive shaft 120 is positioned below the horizontal center of the cartridge along the centerline of the half-cylinder shaped lower reservoirs 112L of bodies 102, 102A.

In illustrating the features shown in FIGS. 8, 17-33 and 37 that will be described herein, only a simplified schematic version of the toner cartridge and housing 100 to is shown.

Figure 8:
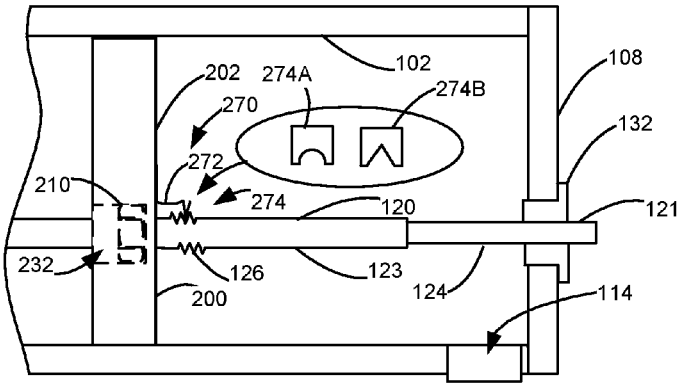
FIG. 8 illustrates a simplified schematic view of a toner cartridge having a toner platform with a frangible area and an optional thread follower and an optional one-way clutch/bearing.

As shown in FIG. 8, a further feature may be provided on toner platform 200. As shown there, a thread follower 270 or thread cleaner can be positioned on the front surface 202 of toner platform 200. The thread follower 270 in one example form comprises an arm 272 attached at one end to front surface 202 and extending in a direction generally parallel to drive shaft 120. At the distal end of arm 272 is a head member 274 or thread follower that engages with the thread 126 on drive shaft 120 to clean toner from the thread prior to it reaching nut 210. The head member 274 may be formed of two members in a V-shape and pitched to correspond to the pitch of the thread 126 on drive shaft 120. As shown in the insert of FIG. 8, the head member 274 be a single member 274A having a U-notch or a single member 274B having a V-notch at its free end to engage with the thread 126 on drive shaft 120. Arm 272 is biased to urge the thread follower 274 into engagement with thread 126. Also illustrated in FIG. 8 is a clutched bearing 132 mounted in first end wall 108 through which the first end 121 of drive shaft 120 passes. Clutched bearing 132 provides uni-directional rotation of drive shaft 120 so that toner platform 200 is driven toward the exit port 114.

Figure 9:
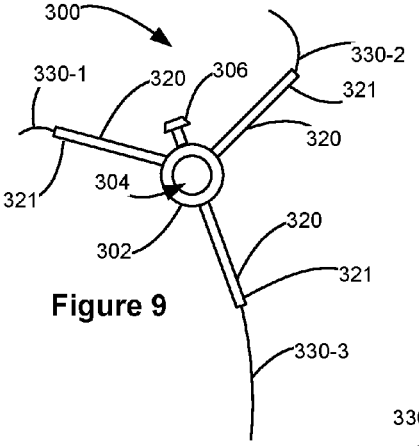
FIGS. 9-12 illustrate example embodiments of an exit paddle used in the toner cartridge of the present invention where
Figure 10:
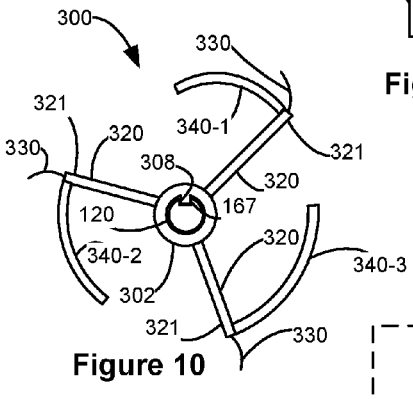

Exit paddle 300 is attached to drive shaft 120 and positioned to push toner out of reservoir 112 through exit port 114 as it rotates. As shown in FIG. 4, exit paddle 300 is attached to a portion of drive shaft 120 adjacent to first end wall 108. Exit paddle 300 rotates with drive shaft 120 and rotates generally parallel to first end wall 108 and front surface 202 of toner platform 200. Exit paddle 300 is sized to fit within the lower toner reservoir 112L of body 102. Referring now to FIGS. 9-13, exit paddle 300 has a drive hub 302 having an opening 304 therethrough to permit it to be positioned onto drive shaft 120 above exit port 114 (as viewed in FIG. 4). A set screw 306, a key 308 or keyway 310 may be provided in drive hub 302 to position and affix exit paddle 300 to drive shaft 120. A corresponding keyway 167 or key 168 may be provided in drive shaft 120 to engage key 308 or keyway 310. At least one radial arm, generally indicated by reference numeral 320, extends from drive hub 302 and is used to push toner to and through exit port 114. Arm 320 extends axially along drive hub 302 and has a generally rectangular shape (see FIG. 4). As shown in FIG. 3, exit paddle 300 has four equally spaced radial arms 320 while three spaced radial arms 320 are shown in FIGS. 9-12. Fewer or more arms 320 may be provided as desired. The radial arms 320 are sized to have a length so that their distal or free ends 321 are close to the interior wall of the lower reservoir 112L in body 102 and to have a width that is about that of the width of exit port 114 in the axial direction. One or more radial scrapers, generally designated by reference numeral 330, may be provided at or adjacent free ends 321 of radial arms 320. During rotation of exit paddle 300, the scrapers 330 extend the reach of the radial arms 320 into the upper toner reservoir 112U of bodies having shapes likes body 102, 102A. The scrapers 330 may be made of an elastomeric material such as MYLAR or other resilient materials and affixed onto radial arms 320 by adhesives or other known fasteners. The scrapers 330 may be of the same length as shown in FIG. 10 or may be of different lengths as indicated by scrapers 330-1, 330-2, 330-3 as shown in FIG. 9.

Figure 11:
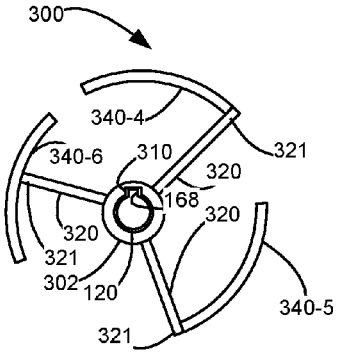
Figure 12:
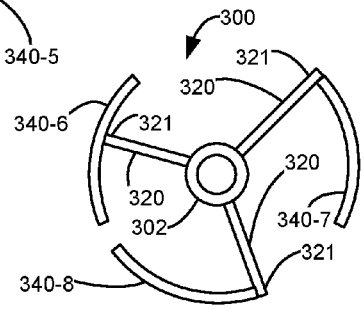

FIGS. 10-13 illustrate variations of another feature that may be provided on exit paddle 300. These are arcuate arm extensions, generally indicated by the reference numeral 340, that are curved to conform to the shape of the lower toner reservoir 112L of body 102. The arm extensions 340 may be of the same length as shown in FIG. 11 or may be of different lengths as indicated by scrapers 340-1, 340-2, 340-3 shown in FIG. 10. In FIG. 10, arm extensions 340-1, 340-2, 340-3 are shown extending from their respective radial arms 320 in a counter-clockwise direction as viewed. In FIG. 11, arm extensions 340-4, 340-5 extend in a counter-clockwise direction from their respective radial arms 321 while arm extension 340-6 extends from its respective radial arm 321 in both the clockwise and counter-clockwise directions. In FIG. 12, arm extensions 340-7, 340-8 extend in a clockwise direction from their respective radial arms 321 while arm extension 340-6 is shown extending from its respective radial arm 321 in both the clockwise and counter-clockwise directions. All arm extensions 340 may be positioned as shown with arm extension 340-6. The arm extensions 340 aid in pushing toner into exit port 114 and, when sized to extend across exit port 114, may be used as an internal shutter to close exit port 114.

Figure 13:
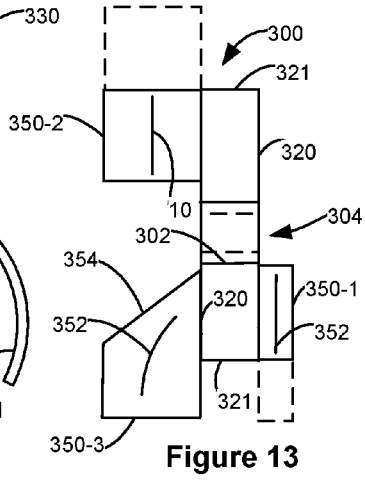
FIG. 13 illustrates examples of platform and end wall wipers provided on the exit paddle.

In addition to the radial scrapers 330 and arm extensions 340, exit paddle 300 may also be provided with one or more lateral scrapers, generally designated with the reference numeral 350 as shown in FIG. 13. Axial scraper 350-1 axially extends toward first end wall 108 and scrapes the interior surface 109*i* of first end wall 108. Axial scraper 350-2 axially extends toward second end wall 110 and, when the toner platform 200 approaches the junction 125 between the threaded portion 123 and unthreaded portion 124 will begin to scrape the front surface 202 of toner platform 200 based on the thickness of toner platform 200 in the axial direction. Each of axial scrapers 350-1, 350-2 may extend beyond the free end 321 of radial arms 320 as indicated by the dashed lines. Further, axial scraper 350-2 may have other shapes than the generally rectangular shape shown. For example, axial scraper 350-3 illustrates an axial scraper having a portion extending beyond the free end 321 of radial arm 320 and an inner angled portion 354 that would help funnel toner away from the toner platform 200 and into the rotational path of radial arms 320. In operation, axial scrapers 350 may be folded, bent, or creased as indicated by lines 352. Axial scrapers 350 may be fabricated from the same materials as radial scrapers 330 and attached using the same fasteners or adhesives.

Figure 14:
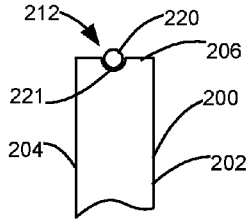
FIGS. 14-16 illustrate various edge seals for use with the toner platform where
Figure 15:
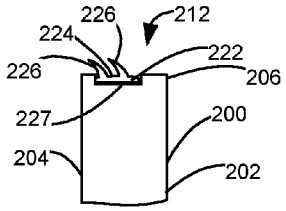
Figure 16:
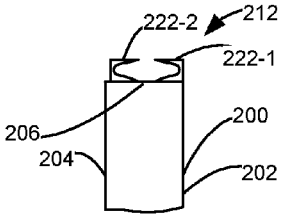

Referring now to FIGS. 4 and 14-16, along edge surface 206 of toner platform 200, one of more circumferential edge seals 212 may be provided to close the gap between toner platform 200 and the interior wall reservoir 112 of body 102 to prevent toner from leaking behind the toner platform 200 as it is driven along drive shaft 120 toward exit port 114. Edge seal 212 may be an adhesively applied foam strip or be an o-ring seal 220 as shown in FIG. 14 seated in a circumferential groove provided in edge surface 206. Edge seal 212 in another form, as shown in FIGS. 15-16, may be a rib seal having a base 224 that may be overmolded onto edge surface 206 or fastened by adhesive. Extending outwardly in a cantilevered manner from base 224 is at least one rib 226 that would contact the inner surface 103*i* of body 102 when platform 200 is installed in body 102. Multiple ribs 226 may also be formed on base 224. FIG. 15 also shows that rib seal 222 may be seated in a circumferential recess 227 in edge surface 206. A plurality of edge seals may be provided as shown in FIG. 16 where two rib seals 222-1, 222-2 are shown on edge surface 206. FIG. 15 illustrates that ribs 226 extend toward rear surface 204 of platform 200. In FIG. 16, rib seal 222-1 is oriented in the same manner as rib seal 222 of FIG. 15 while rib seal 222-2 is shown in an opposite orientation.

When the toner cartridge 35 is initially filled, the toner platform 200 is positioned adjacent to one of the end walls 108, 110. As shown in FIG. 4, toner platform 200 is positioned next to end wall 110 and during rotation of drive shaft 120 will translate toward the exit paddle 300 and exit port 114. Toner platform translation toward the exit port 114 will be described as "forward translation" while toner platform translation away from the exit port 114 will be termed "reverse translation."

Drive shaft 120 is rotated to drive nut 210 and toner platform 200 in forward translation along the threaded portion 123 thereof to push the toner, when present, within reservoir 112 toward exit port 114. Threaded portion 123 extends from adjacent one end of the drive shaft near one wall (e.g., second end wall 110) that is farthest from the exit paddle 300 to the junction 125 which is a predetermined distance away from the other end wall (e.g., first end wall 108) closest to the exit paddle 300. The unthreaded portion 124 is large enough to accommodate the toner platform 200 between the junction 125 and the exit paddle 300. The minimum width of unthreaded portion 124 between the exit paddle 300 and the junction 125 is equal to or greater than the thickness of toner platform 200 including that of drive nut 210. For example, if the overall thickness of the toner platform 200 and drive nut 210 is 100 mm and the width of exit paddle 300 is 100 mm, then the predetermined distance of the junction 125 from the end wall 108 would be approximately 200 mm or greater with the minimum width of the unthreaded portion 124 of the drive shaft 120 between the junction 125 and the exit paddle 300 being at least 100 mm. These dimensions are a matter of design choice.

When drive nut 210 travels off of the threaded portion 123 during forward translation and onto the unthreaded portion 124 of drive shaft 120 at junction 125, toner platform 200 stops translating preventing toner platform 200 from being driven into exit paddle 300. This allows any residual toner T contained between the front face 202 of toner platform 200 and first end wall 108 to continue to be fed out through exit port 114 by exit paddle 300. Without the unthreaded portion 124, toner platform 200 would be driven into exit paddle 300 leading to possible binding or breakage of drive shaft 120 while deliverable toner T remained in housing 100. The slightly smaller diameter of unthreaded portion 124 helps to ensure that nut 210 disengages from drive shaft 120 at junction 125.

During forward translation when the drive nut 210 is on the threaded portion 123, each revolution of the drive shaft 120 causes a known volume of toner to be delivered through the exit port 114. Accordingly, counting the number of revolutions of drive shaft 120 provides a means for determining the amount of toner remaining in the toner cartridge 35. When the drive nut 210 has traveled onto the unthreaded portion 124 of the drive shaft 120 or has otherwise broken free or become disconnected from toner platform 200, toner cartridge 35 is near empty and the torque load on the drive shaft 120 will be significantly reduced as only the exit paddle 300 is being driven by drive shaft 120. Thus, by monitoring the torque needed to rotate the drive shaft 120, a user can be alerted that the toner cartridge 35 is at the end of its life and will need replacement.

Where clutches or other unidirectional mechanisms are not employed, toner platform 200 may be driven in reverse translation. This may be done to clear the threaded portion 123 of a plug of toner or to allow toner within toner reservoir 112 to decompress.

FIGS. 17-20 illustrate a detachable coupling affixed to the toner platform 200 where the coupling detaches from the toner platform when the toner platform reaches a predetermined stop position during its forward translation toward the exit port thereby preventing further translation toward the exit port.

Figure 17:
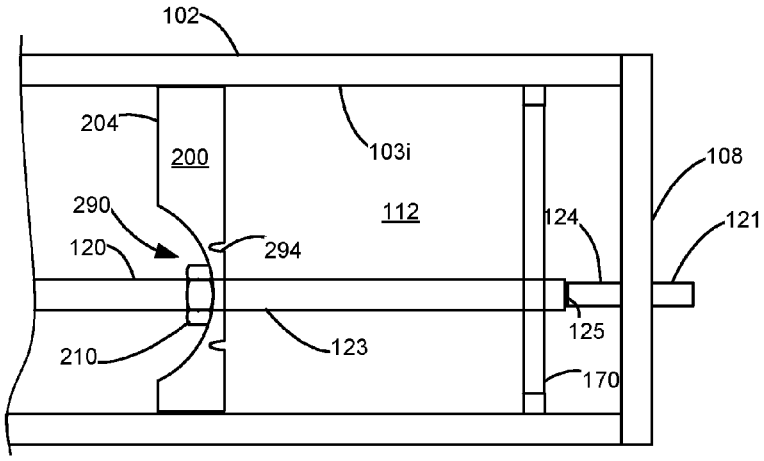
FIGS. 17-20 are simplified schematic views that illustrate decoupling of the toner platform used when the toner platform has reached its end of travel.
Figure 18:
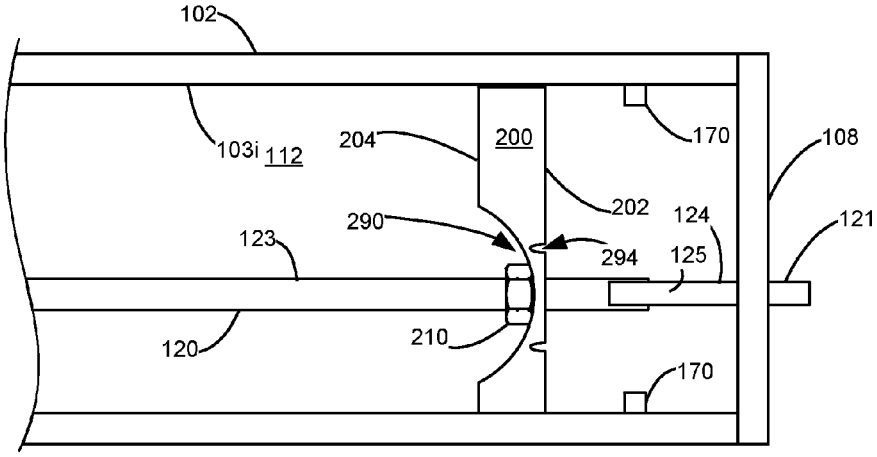
Figure 19:
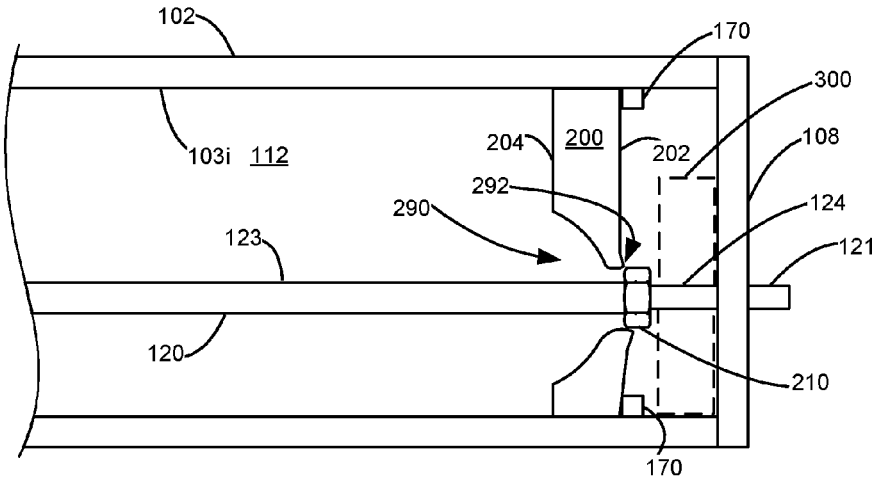

FIGS. 17-19 illustrate a further feature—a frangible region—that may be provided on toner platform 200 allowing the coupling 210 to be detachably affixed to the toner platform 200. FIGS. 17-19 provide a simplified illustration of the cartridge showing only the toner platform 200, drive shaft 120 within a portion of the body 102 of housing 100 and first end wall 108. A recessed region 290 of toner platform 200 has been thinned as indicated at 290 in the form of a hemisphere formed in rear surface 204. Other shapes may be used to achieve the desired degree of thinness within this region. This region is termed a frangible region 290. One or more internally projecting stops 170 have been provided within toner reservoir 112 to form the pre-determined stop position for toner platform 200. Stop 170 may be a continuous ring as shown in FIG. 17 and extend inwardly from inner surface **103*i* and about the entire inner perimeter of toner reservoir 112 or may be one or more posts formed on inner surface 103*i* as shown in FIGS. 18-19 where two stops 170** are shown.

In FIG. 17, toner platform 200 is approaching stop 170 during forward translation. As forward translation continues, toner platform 200 eventually reaches stop 170 as shown in FIG. 18. Because toner platform 200 is being held in place by stop 170, the drive torque will increase to and exceed a predetermined magnitude causing drive nut 210 to be driven through the front surface 202 of toner platform 200 eventually breaking free as shown at 292. With nut 210 broken free of or disengaged from toner platform 200, toner platform 200 is disengaged from drive shaft 120 with forward translation ceased. Forward translation of drive nut 210 also ceases as a result of unthreaded portion 124 of drive shaft 120.

Stop 170 is positioned axially inset from first end wall 108 to minimize the distance between the exit paddle 300 and the front surface 202 of toner platform 200 to reduce the amount of residual toner left in housing 100 but yet to be at a sufficient distance such that drive nut 210 can break free of toner platform 200. With reference to second end wall 110, threaded portion 123 extends a predetermined length toward the exit port 114 or first end wall 108. Stop 170 is positioned at a predetermined position within the reservoir 112 along threaded portion 123 away from junction 125.

As previously explained, exit paddle 300 having radial scrapers 330 and axial scrapers 350 may be used to deliver the toner remaining between the front surface 202 of toner platform 200 and exit paddle 300 from toner cartridge 35. As shown in FIGS. 17-18, a second frangible region 294 may be provided on front surface 202 of toner platform 200 in combination with frangible region 290 or in place of it. As illustrated, second frangible region 294 may comprise a circular or elliptical recess about drive nut 210. Other variations for thinning the toner platform 200 in the region of coupling 210 may be used to equal effect.

Figure 20:
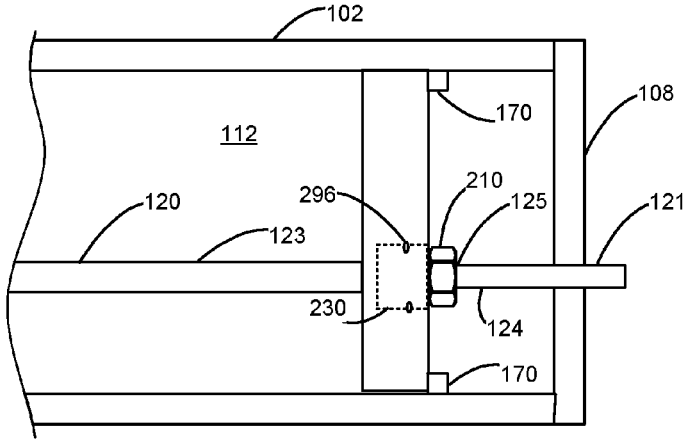

FIG. 20 illustrates another form of disengaging coupling 210 from toner platform 200 upon reaching stop 170. As shown there, recess 230 is provided in the front surface 202 of toner platform 200. Recess 230 is sized to frictionally engage coupling 210 to prevent coupling 210 from rotating relative to toner platform 200. Upon reaching stop 170, drive shaft 120 continues to rotate with coupling 210 eventually exiting from recess 230 as shown and rotating freely on threaded portion 123 or unthreaded portion 124 adjacent junction 125. Shown in recess 230 is an internal coupling restraint 296 depending inwardly into recess 230. Coupling restraint 296 provides additional resistance to the forward translation motion of coupling 210 within recess 230 to help ensure that coupling 210 does not break free from toner platform 200 prior to reaching stop 170. Coupling restraint 296 may be made from a compressible or compliant material such as rubber or an elastomeric material such as SANTOPRENE. The coupling restraint 296 may be positioned to apply a compressive force directly on the perimeter of coupling 210 or may be positioned in front of coupling 210 as shown to act as a compressible stop. Again, when toner platform 200 reaches stop 170, the drive torque will increase to and exceed a predetermined magnitude causing coupling 210 to break free from or be driven past coupling restraint 296 and out from the recess 230 on front surface 202 of toner platform 200.

By making coupling 210 detachable, the threaded portion 123 of drive shaft 120 may be extended up to or beyond where exit paddle 300 is mounted on drive shaft 120.

Figure 25:
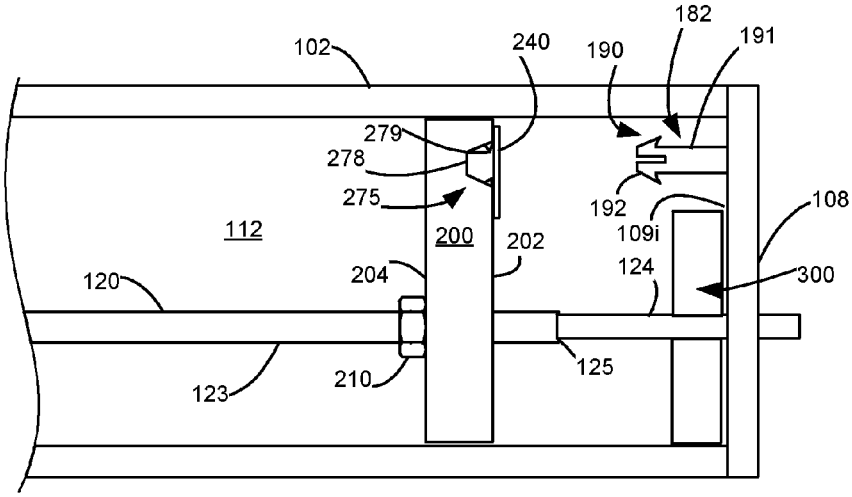
FIGS. 25-26 are simplified schematic views that illustrate another latching system for the toner platform provided on the cartridge housing and used when the toner platform has reached its end of travel.
Figure 26:
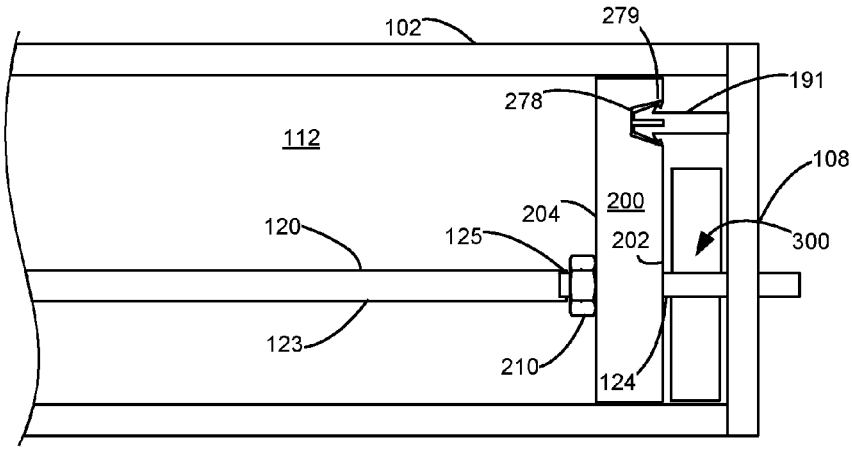
Figure 27:
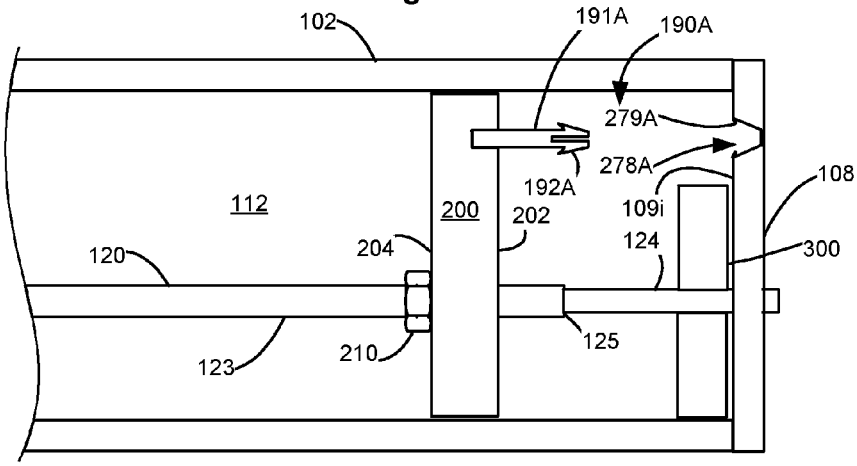
FIG. 27 is a simplified schematic view illustrating another form of the latching system illustrated in FIGS. 25-26.
Figure 28:
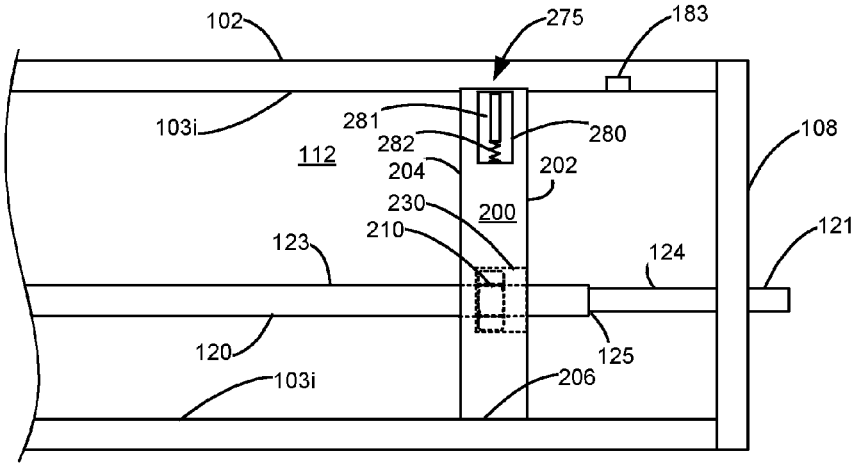
FIGS. 28-29 are simplified schematic views illustrating a further form of a latching system.
Figure 29:
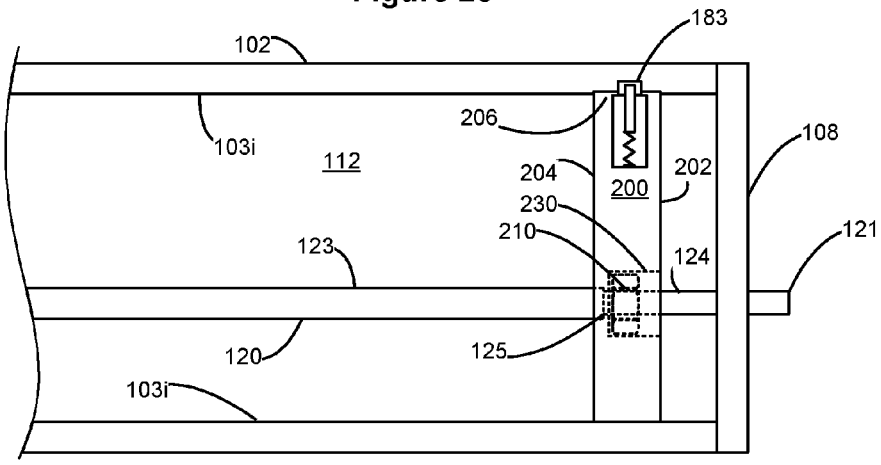
Figure 32:
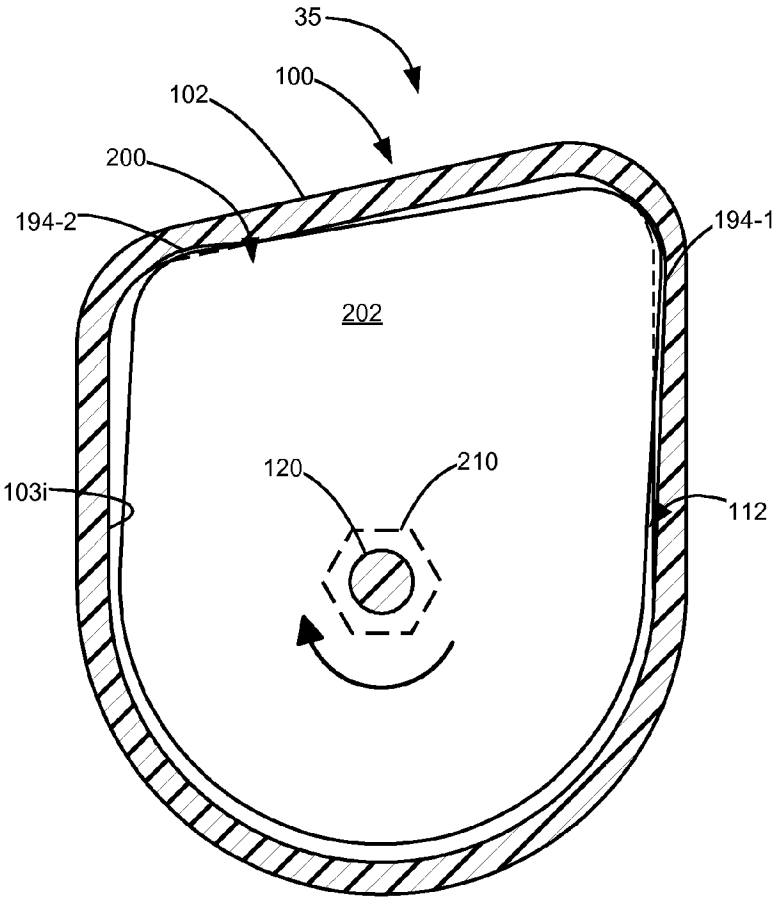
FIGS. 31-32 are sectional illustrations of a further form of a latching arrangement for the toner platform.
Figure 31:
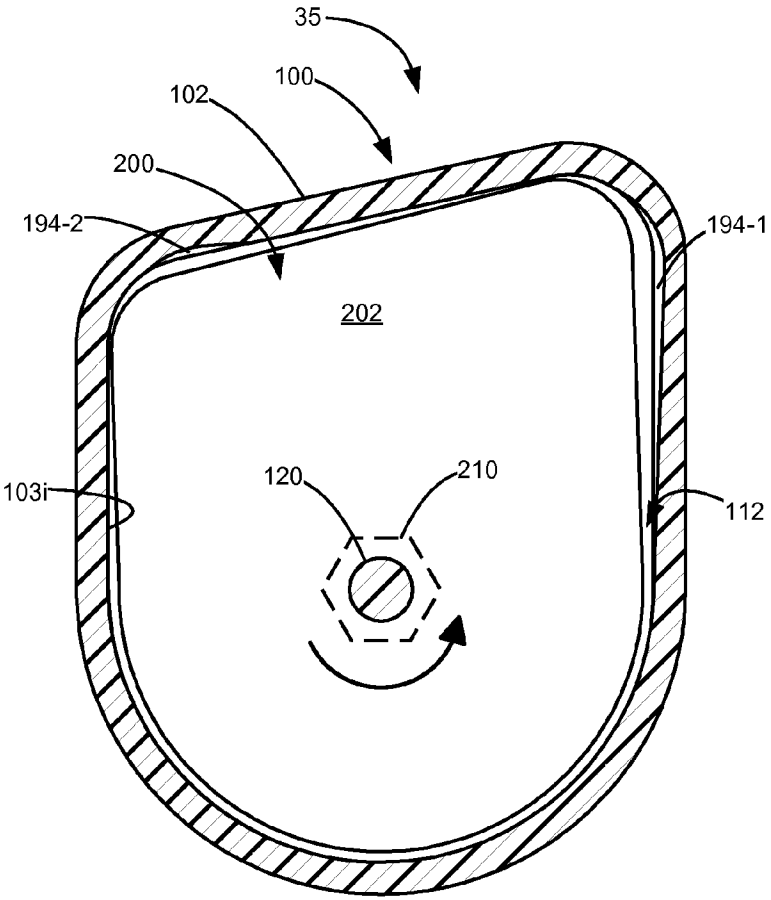

FIGS. 21-29 and 31-32 illustrate retention mechanisms for toner platform 200. FIGS. 21-24 illustrate the use of resilient or spring biased retention members. FIGS. 25-27 show the use of a retention post. FIGS. 28-29 illustrate the use of a spring biased pin. FIGS. 31-32 illustrate a passive latching arrangement.

Figure 21:
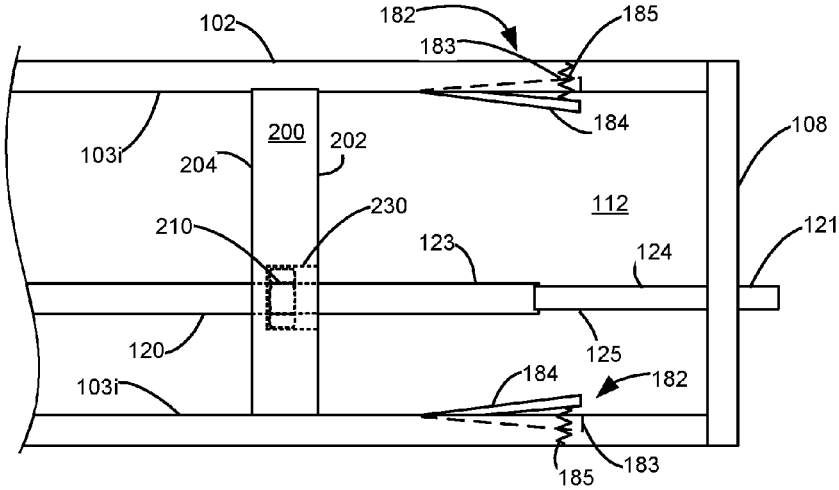
FIGS. 21-23 are simplified schematic views that illustrate a latching system for the toner platform provided on the cartridge housing and used when the toner platform has reached its end of travel.

In FIG. 21, toner platform 200 is shown approaching the junction 125 between threaded portion 123 and unthreaded portion 124 of drive shaft 120. Body retention features, generally indicated by reference numeral 182, are provided on body 102 within the toner reservoir 112. Retention features 182 include at least one recess 183 in the wall of body 102 and at least one retention arm 184 that is sized to fit within recess 183. Two recesses 183 and two arms 184 are shown. Arm 184 is biased to project from body 102 into toner reservoir 112 and into the path of toner platform 200. The free end of arm 184 is axially positioned with respect to drive shaft 120 to be at junction 125 or slightly beyond it in the direction of unthreaded portion 124. Arm 184 may be biased by a spring 185 as shown or may be made of a resilient material or spring steel so that in its rest state it will project into reservoir 112 as shown.

Figure 22:
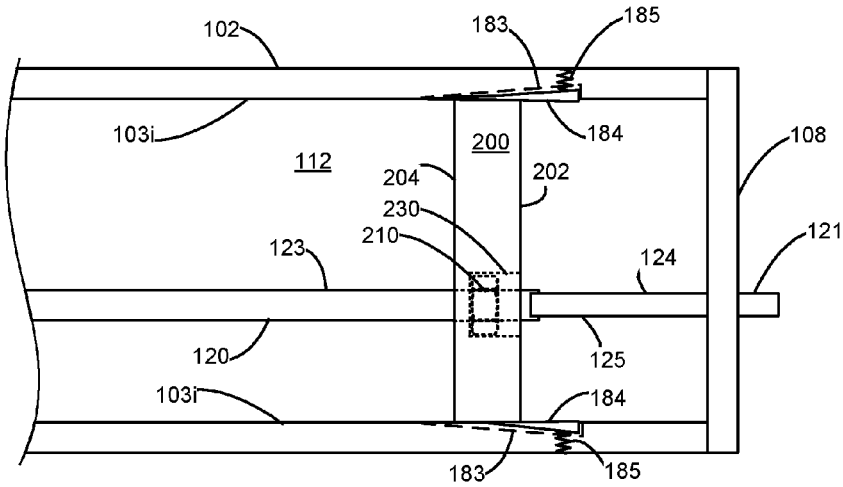
Figure 23:
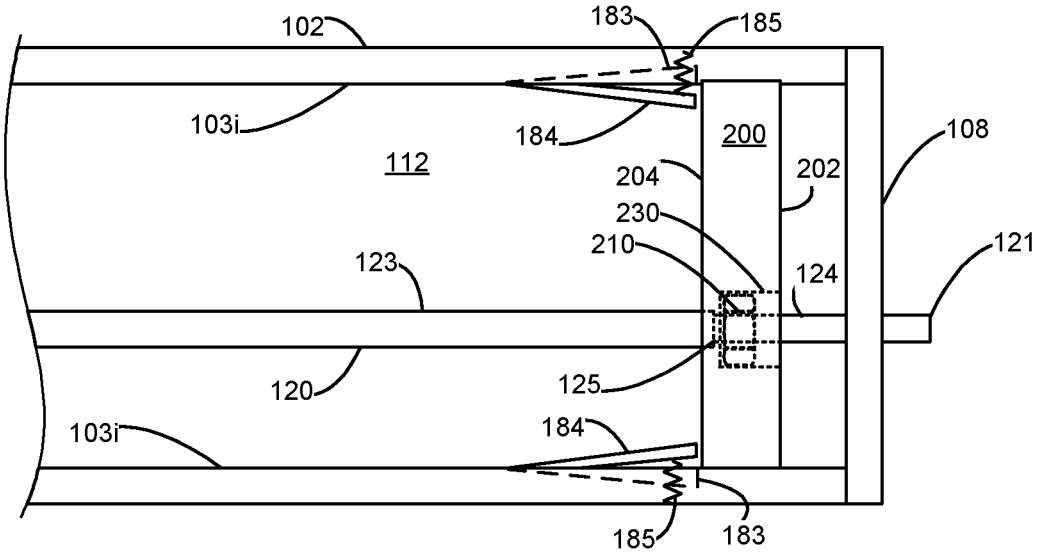

In FIG. 22, toner platform 200 has neared but not passed junction 125 and has encountered arm 184, moving arm 184 into recess 183 and compressing spring 185. This action allows toner platform 200 to continue its travel toward junction 125. In FIG. 23, coupler 120 has traveled off of threaded portion 123 and onto unthread portion 124 of drive shaft 120 and the toner platform 200 has ceased its travel toward first end 108. At this point, the rear surface 204 of toner platform 200 has traveled past the recesses 183 allowing arm 184 to spring out behind toner platform 200. Should the rotation of drive shaft 120 be reversed, the arms 184 prevent coupler 210 on toner platform 200 from re-engaging with the threaded portion 123 of drive shaft 120.

In FIG. 24, platform retention features 275 that are mounted on toner platform 200 are shown in combination with body retention features 182 which function as previously described. A recess 276 is provided on toner platform 200 adjacent edge surface 206, which is sized to house arm 277 that is biased to project into the inner surface 103*i* of body 102 within toner reservoir 112 using similar means as previously described with regard to arm 184. Arm 277 may also be mounted on rear surface 204 of toner platform 200. The dotted line image of arm 277 indicates the recessed position of arm 277, which can be seen as projecting rearward on toner platform 200. As shown, arm 277 extends beyond rear surface 204 of toner platform 200 but it may be contained entirely between the front and rear surfaces 202, 204 of toner platform 200 and biased to move orthogonal to edge surface 206. Toner platform 200 is shown as having attained the unthreaded portion 124 of drive shaft 120. As this point, arm 277 projects into a correspondingly positioned notch 187 provided in the inner surface 103*i* of body 102. In the foregoing, retention features 182, 275 the arms 184, 277 may also be a pogo pin style.

FIGS. 25-27 illustrate another form of a toner platform retention feature. As shown, retention feature 190 comprises a post 191 and a recess 278. Post 191 is shown mounted on the inner surface 109*i* of first end wall 108 extending axially into toner reservoir 112. Post 190 is positioned above the sweep of the radial arms of exit paddle 300. Post 190 includes a latching portion 192 that is sized to be received into recess 278 that is shown provided in the front surface 202 of toner platform 200 and is aligned with post 190. Recess 278 is provided with a latching device, such as a lip 279 extending into recess 278. FIG. 25 shows toner platform 200 approaching junction 125 of drive shaft 120.

In FIG. 26, coupler 210 has been disengaged from threaded portion 123 of drive shaft 120 and latching portion 192 has been received into recess 278 with latching portion 192 being caught on lip 279. Again, should the rotation of drive shaft 120 be reversed, the engagement of post 191 and latching device 279 prevent coupler 210 on toner platform 200 from re-engaging with the threaded portion 124 of drive shaft 120.

Also shown in FIG. 25 is a recess cover 240 that prevents toner from filling recess 278 as toner platform 200 travels through toner reservoir 112. Recess cover 240 is pierced by post 191 when the engagement between the toner platform 200 and post 191 occurs.

FIG. 27 illustrates another form of retention feature 190 wherein the post and recess are reversed. As shown, retention feature 190A has a post 191A having latching portion 192A extending axially from front surface 202 toward inner surface 109*i* of end wall 108. Recess 278A provided on inner surface 109*i* is aligned with post 191A and includes a latching portion 279A for engaging the latching portion 192A of post 191A. Retention feature 190A functions in substantially the same manner as retention feature 190.

FIGS. 28-29 illustrate the use of a spring-biased pin as a platform retention feature 275. A recess is provided in toner platform 200, such as recess 280 in edge surface 206. Recess 280 is shown extending from edge surface 206 toward recess 230. Within recess 280 are pin 281 and bias spring 282 that is shown placed between the bottom of recess 280 and pin 281. Pin 281 has one end in slidable contact with inner surface 103*i* and the other end in contact with bias spring 282 that urges pin 281 toward inner surface 103*i*. Recess 183 is provided in inner surface 103*i* of body 102. Recess 183 is shown as being positioned within the vicinity of junction 125 of drive shaft 120. The exact position of recess 183 between exit paddle 300 and along unthreaded portion 124 or threaded portion 123 of drive shaft 120 is a matter of design choice. In FIG. 28 toner platform 200 has not reached junction 125 of drive shaft 120.

In FIG. 29 toner platform 200 is shown at a point where drive nut 210 has become disengaged from threaded portion 123 of drive shaft 120. The end of pin 281 that was in contact with inner surface 103*i* has entered into recess 183 allowing toner platform 200 to be retained at that location. Multiple recesses and spring biased pins can be provided on toner platform 200 along with corresponding recesses on inner surface 103*i* of body 102.

It should be mentioned that the detachable couplings shown in FIGS. 17-20 may be employed with the various forms of retention features 190.

FIGS. 31-32 illustrate a passive latching arrangement for the toner platform. In FIG. 31 toner platform 200 is shown an intermediate point within toner reservoir 112 undergoing forward translation with drive shaft 120 being rotated in a first direction (an anti-clockwise direction as indicated by the arrow). One or more recesses are provided at a predetermined position on the inner surface 103*i* of body 102 such as for example adjacent to or axially aligned with the junction 125 of drive shaft 120. As illustrated recesses 194-1 and 194-2 are shown along the right side and top of body 102 and are sized to engage a portion of the toner platform 200 therein. When drive shaft 120 is rotated in the first direction, friction between drive shaft 120 and toner platform 200 causes the toner platform 200 to be biased in the first direction as shown in exaggerated fashion in FIG. 31. There the upper right portion of toner platform 200 is shown abutting inner surface 103*i*.

In FIG. 32, upon aligning with recesses 194-1 or 194-2, the direction of rotation of drive shaft 120 is reversed to a second direction (illustrated as clockwise and as indicated by the arrow). When drive shaft 120 is rotated in the second direction, friction between drive shaft 120 and toner platform 200 causes the toner platform 200 to be biased in the second direction as shown in exaggerated fashion in FIG. 31 moving portions of toner platform 200 to be received into recesses 194-1, 194-2, respectively. This prevents toner platform from being able to move in reverse translation upon continued rotation of drive shaft 120 in the second direction. While two axially aligned recesses are illustrated, additional recesses may be provided a multiple axial locations on the inner surface 103*i* of body 102 along the length of drive shaft 120.

Figure 30:
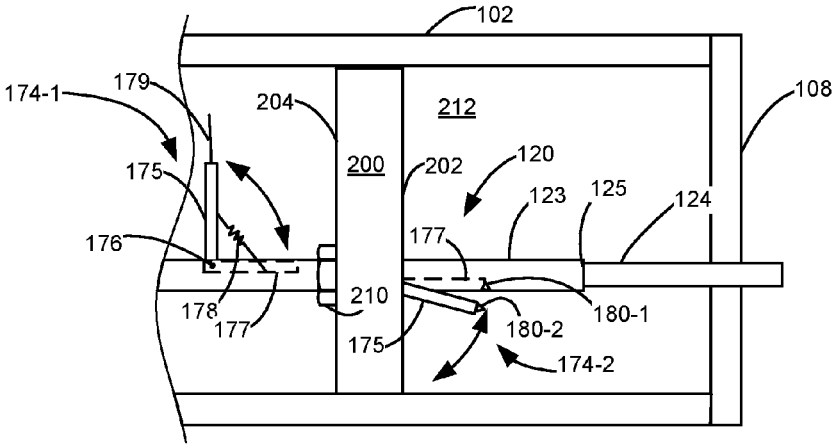
FIG. 30 is a simplified schematic view of an embodiment of the toner cartridge having drive shaft mounted stirring rods.

FIG. 30 illustrates an additional feature of drive shaft 120. Drive shaft 120 may be provided with one or more toner stirring rod assemblies. Two stirring rod assemblies 174-1, 174-2 are shown. As seen in assembly 174-1, rod 175 is mounted on a pivot 176 in recess 177 provided in drive shaft 120. A bias spring, such as spring 178, biases rod 175 to be cantilevered outward away from drive shaft 120, such as orthogonal to drive shaft 120. As the drive shaft 120 rotates, rod 175 stirs the toner within reservoir 112. As platform 200 travels toward the first end wall 108 it will encounter the rod 175. As shown with stirring rod assembly 174-2, rod 175 is designed to fold into recess 177 to allow coupler 210 and platform 200 to pass over it. As the toner platform 200 and/or coupler 210 clear each toner stirring assembly, the rod 175 is again free to return to its biased position. Additionally, a flexible wiper 179 may be attached to the free end of rod 175 allowing it to reach into the upper portion of the toner reservoir 112. A latching member 180-1, 180-2 may be provided in recess 177 or on the rod 175, respectively if it is desired that the rod 175 be retained in recess 177 after toner platform 200 passes over a stirring rod assembly. This would allow drive shaft 120 to be reversed drawing toner platform 200 back toward second end wall 110. The number of stirring rod assemblies as well as their axial and radial spacing is a matter of design choice.

Figure 33:
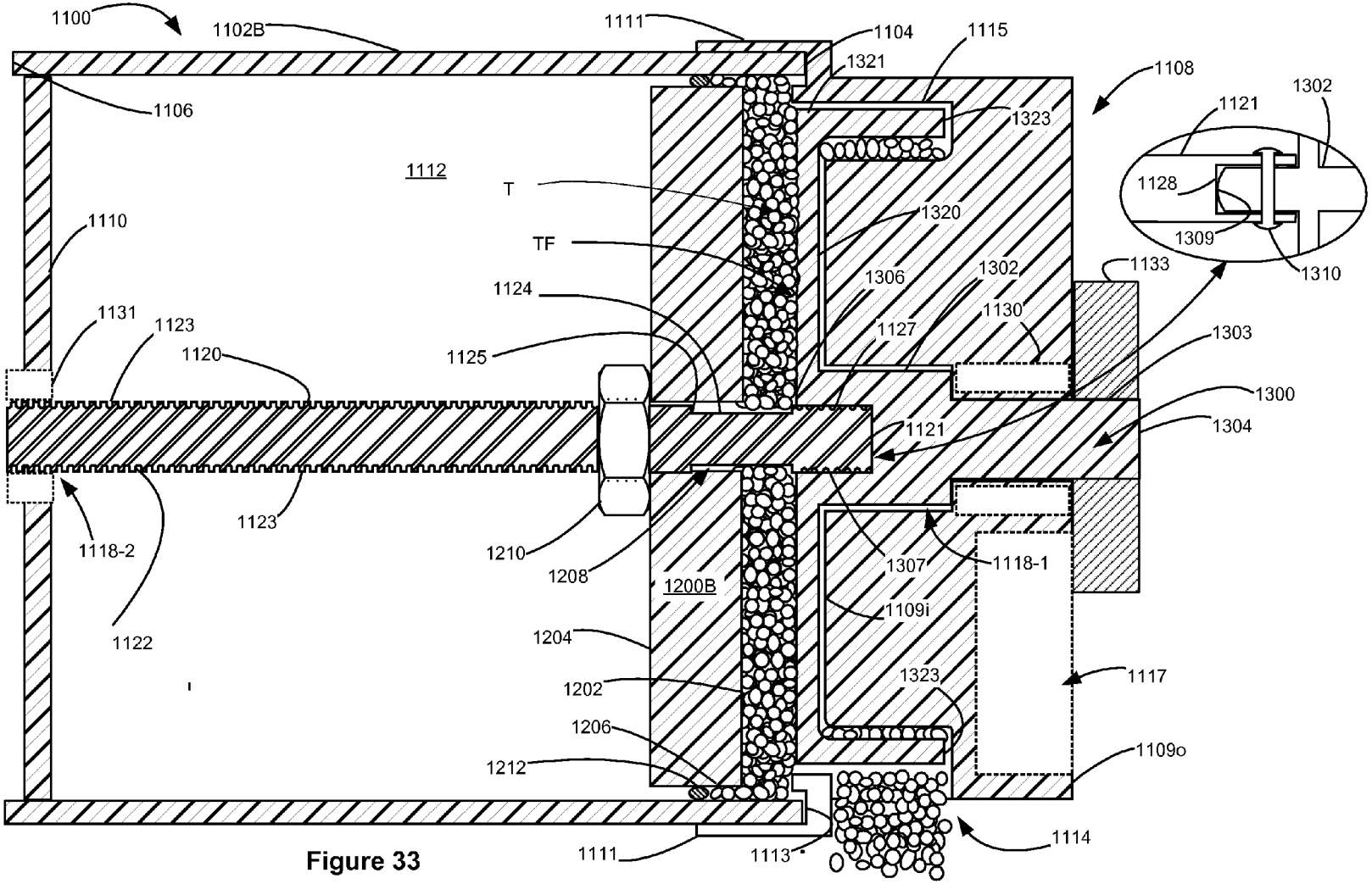
FIG. 33 is a sectional illustration of an embodiment of the toner cartridge utilizing a removable exit paddle.

In FIG. 33, a sectional view of a toner cartridge is shown having another arrangement of the exit paddle and first end wall. To the extent possible similar numbering will be used with respect to similar elements shown in FIGS. 3-12. The toner cartridge includes a housing 1100 that is substantially the same as housing 100. Housing 1100 includes an elongated body 1102B having a first end 1104 and a second end 1106 that are enclosed by first end wall 1108 and second end wall 1110 and which collectively form a toner reservoir 1112 within housing 1102. An exit port 1114 is provided in first end wall 1108 and is in fluid communication with toner reservoir 1112. For purposes of illustration only body 1102B is shown as being cylindrical but one of ordinary skill in the art would recognize that bodies 102, 102A shown in FIGS. 5 and 6, respectively may also be used.

Aligned openings 1118-1, 1118-2 are provided in first and second end walls 1108, 1110, respectively. A drive shaft 1120 extends the length of the body 1102B with first and second ends 1121, 1122 thereof received in opening 1118-1, 1118-2, respectively. First end 1121 of drive shaft 1120 is illustrated as extending through first end wall 1108 beyond outer surface 11090 thereof. Drive shaft 1120 has a threaded portion 1123 and an unthreaded portion 1124 that meet at a junction 1125. Unthreaded portion 1124 is shown having a slightly smaller diameter than threaded portion 1123. Coupled to drive shaft 1120 are an exit paddle 1300 and a toner platform 1200B that is again substantially the same as toner platform 200B. As shown, exit paddle 1300 is threadably engaged with the first end 1121 of drive shaft 1120. A drive coupler 1133 is attached to exit paddle 1300 and, when housing 1102B is inserted into imaging apparatus 22, drive coupler 1133 removably engages with a drive mechanism (not shown) provided within imaging apparatus 22 to receive rotational force. First end 1104 of body 1102B may also be termed the drive end while second end 1106 of body 1102B may be termed the non-drive end. The size and configuration of drive coupler 1133 is a matter of design choice and may include a gear or gear train or a coupler such as an Oldham coupler as is known in the art. First and second bearings 1130, 1131, if provided, may be mounted in aligned opening 1118-1, 1118-2 in end walls 1108, 1110. Second bearing 1131 is shown mounted about second end 1122 of drive shaft 1120 while first bearing 1130 is shown mounted about a drive hub extension 1303 of exit paddle 1300. End walls 1108 and 1110 may be fabricated from a bearing-grade plastic obviating the need for separate bearings. One or both bearings 1130, 1131, may be a clutched bearing to provide for uni-directional rotation of drive shaft 1120, if desired.

An end cap including a handle, as previously described, may be provided at second end 1106 of body 1102B. A vent hole as previously described may also be provided in end walls 1108, 1110 or body 1102. Keying features, previously described, may be provided on first end wall 1108. The attachment of first and second end walls 1108, 1110 to body 1102 may be made by any of the means previously described. Further, one the end walls 1108, 1110 may be integrally formed with the body 1102.

Toner platform 1200B is illustrated as being circular and corresponds in shape to toner platform 200B. The toner platform 1200B includes a front surface 1202 that is used to push the toner within the reservoir 1112 toward the exit port 1114, a rear surface 1204, and an edge surface 1206 interconnecting the front and rear surfaces 1202, 1204. An opening 1208 is provided through toner platform 1200B for the drive shaft 1120. A coupling 1210 is mounted in or on toner platform 1200B about opening 1208 to movably couple toner platform 1200B to drive shaft 1120. As shown, coupling 1210, such as drive nut 1210, is attached to rear surface 1204 of toner platform 1200. The other forms of attaching coupling 1210 to toner platform 1200B previously illustrated may also be used and will not be further described. An edge seal 1212 is provided on toner platform 1200B. The other features previously described for toner platforms 200, 200A, and 200B may also be provided for toner platform 1200B. Toner platform 1200 may also contain orienting features as shown in FIG. 7.

As shown in FIG. 33, exit paddle 1300 has a drive hub 1302 having a first end 1304 located on a drive hub extension and a second end 1306. First end 1304 extends through first end wall 1108. Drive hub 1302 of exit paddle 1300 is threadably engaged via opening 1307 provided at a second end 1306 thereof with a second threaded portion 1127 of drive shaft 1120 adjacent the first end 1121 thereof. Other forms of attaching exit paddle 1300 to the first end 1121 of drive shaft 1120 can be used and are a matter of design choice.

Exit paddle 1300 has a plurality of radial arms 1320 mounted on drive hub 1302. However, unlike radial arms 320 that extend across the width of exit port 114, radial arms 1320 are narrower in width and more spoke-like. At the free end 1321 of one or more of arms 1320 is an axial extending finger 1323 that in one form extends toward first end wall 1108 or parallel to drive hub 1302. Provided in the inner surface 1109*i* of first end wall 1108 is an annular recess 1115 that is sized to receive the axial fingers 1323 while allowing them to be rotatable therein. Exit port 1114 is in fluid communication with the annular recess 1115.

Toner platform 1200B is coupled via drive nut 1210 on the threaded portion 1123 of drive shaft 1120. The second end 1122 of drive shaft 1120 is received into opening 1118-2 of second end wall 1110 that is attached to second end 1106 of body 1102. Initially, toner platform 1200B is positioned adjacent to second end wall 1210. Exit paddle 1300 is threaded onto second threaded portion 1127 of drive shaft 1120. First end wall 1108 is then placed over first end 1104 of body 1102 with drive hub extension 1303 passing through opening 1118-1. A flange 1111 having a channel 1113 therein depends from first end wall 1108. The first end 1104 of body 1102 is received into channel 1113 sealing the first end 1104 of body 1102. The first end wall 1108 is attached to body 1102 by adhesives, ultrasonic welding, or other fasteners. Toner reservoir 1112 may be filled with toner T prior to attachment of first end wall 1108 or afterward through a fill port provided, for example, in either first or second end walls 1108, 1110.

During operation, as drive shaft 1120 is rotated in a first direction, toner platform 1200B is driven toward first end wall 1108 pushing the toner through the radial arms 1320 of exit paddle 1300 into annular recess 1115 of first end wall 1108. Toner T is substantially confined between the front face 1202 of toner platform 1200B and the inner surface 1109*i* of first end wall 1108. Exit paddle 1300 rotates synchronously with drive shaft 1120 with axial fingers 1323 sweeping toner T within annular recess 1115 and into exit port 1114 for delivery to imaging apparatus 22.

Because the radial arms 1320 of exit paddle 1300 are thin, approximately 1.5 mm in thickness as viewed in FIG. 29, and spaced apart, the majority of the toner face TF is against the inner surface 1109*i* of end wall 1108. A small portion of the toner face TF is against the outer radial surface of the arms 1320 (the outer radial surface being the surface of arm 1320 that is the most distant from inner surface 1109*i* of first end wall 1108) and is supported by them. The toner face TF tends to remain intact and not avalanche into recess 1115. This in turn helps to ensure a more uniform delivery of toner per revolution of drive shaft 1120. Avalanching of the toner would leave an irregular void between toner platform 1200B and the inner surface 1109*i* of end wall 1108 that would effectively reduce the volume of toner exiting through exit port 1114 until such void was eliminated. The spacing between axial fingers 1323 and annular recess 1115 shown in FIG. 33 has been exaggerated for illustrative purposes. Annular recess 1115 in one form is sized to closely receive axial fingers 1323. For example, for axial fingers having a thickness of about 2 mm and a length of about 9.5 mm the height of annular recess would be approximate 3 mm and its depth about 9.5 mm. The ends of the axial fingers are within about 0.5 mm from the bottom of annular recess 1115. The length of axial fingers 1323 in one form is about the width of exit port 1114 with the depth of annular recess 1115 being slightly greater than the length of axial fingers 1323.

Toner platform 1200B disengages from drive shaft 1120 when drive nut 1210 passes the junction 1125 and travels onto the unthreaded portion 1124 of drive shaft 1120 so that toner platform 1200B will not be driven into exit paddle 1300.

The retention devices, thread followers, seals, and frangible portions previously described may also be employed with housing 1100, toner platform 1200B and/or drive shaft 1120. Drive shaft 1120 may also be provided with one or more stirring rod assemblies 174 as desired.

Figure 34:
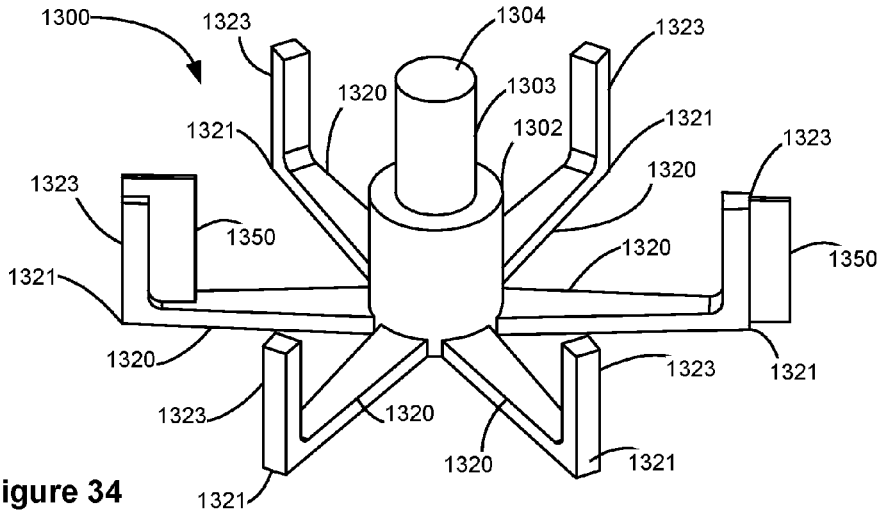
FIGS. 34-36 are illustrations of embodiments of removable exit paddles.

FIGS. 32-34 illustrate various example exit paddle embodiments. Each exit paddle 1300, 1300A, and 1300B has a drive hub 1302 having a drive hub extension 1303 and a first end 1304 and second end 1306. Each exit paddle 1300, 1300A, and 1300B has an opening in second end 1306 (see FIG. 33) to engage with the first end 1121 of drive shaft 1120. Alternatively, the first end 1121 of drive shaft 1120 may have an opening for receiving a portion of drive hub 1302 therein as shown in the inset portion of FIG. 33. Exit paddles 1300, 1300A have a plurality of radial arms 1320 extending out from drive hub 1302 and adjacent to the second end 1306. At their respective free ends 1321 are axially extending fingers 1323 that extend parallel to drive hub 1302 but are radially spaced apart therefrom. Although each radial arm 1320 is illustrated as having an axial finger 1323, the fingers 1323 do not need to be on each arm 1320. Axial scrapers 1350 may be provided along the inner and/or outer radial surfaces and/or tip of one or more of the fingers 1323 to engage with the inner and/or outer radial surfaces of annular recess 1115 (See FIG. 34).

Figure 35:
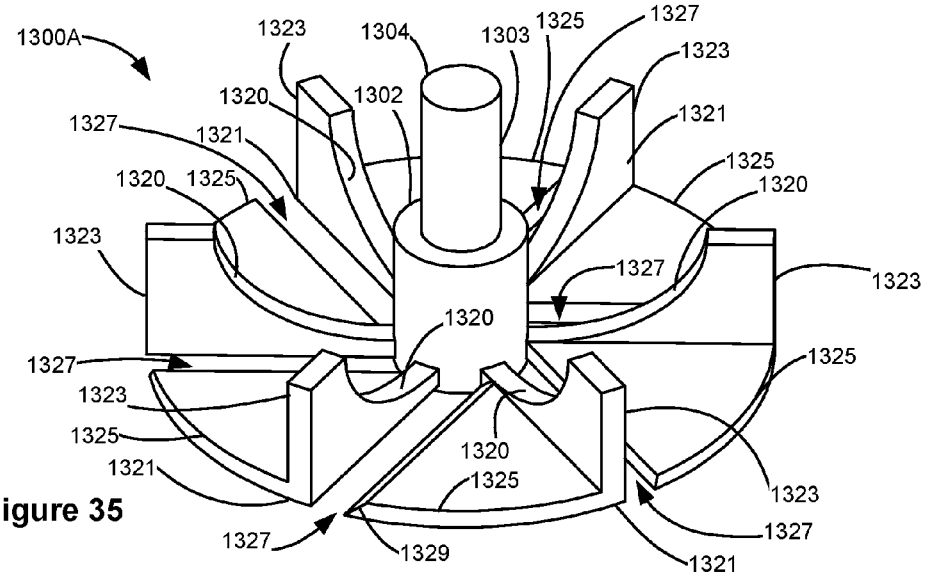

Exit paddle 1300A shown in FIG. 35 also illustrates a fan-shaped skirt 1325 attached to one or more of the radial arms 1320. Extending substantially in the radial plane of and along the length of the arms 1320, the skirt 1325 extends toward but does not connect with an adjacent arm 1320 forming a slot 1327 therebetween through which toner may flow to enter into annular recess 1115. The edge 1329 of the skirt 1325 adjacent the slot 1327 may be sloped from the outer surface of the skirt 1325 toward the inner surface thereof (the inner surface being the upper surface of skirt 1325 as viewed in FIG. 35 which would be adjacent inner surface 1109*i* of first end wall 1108). As the exit paddle rotates, the skirt 1325 acts to support the toner face TF while edge 1329 acts to shave or grate toner from toner face TF and direct it to annular recess 1115. Annular recess 1115 may be increased in diameter to correspond to the length of slot 1327.

Figure 36:
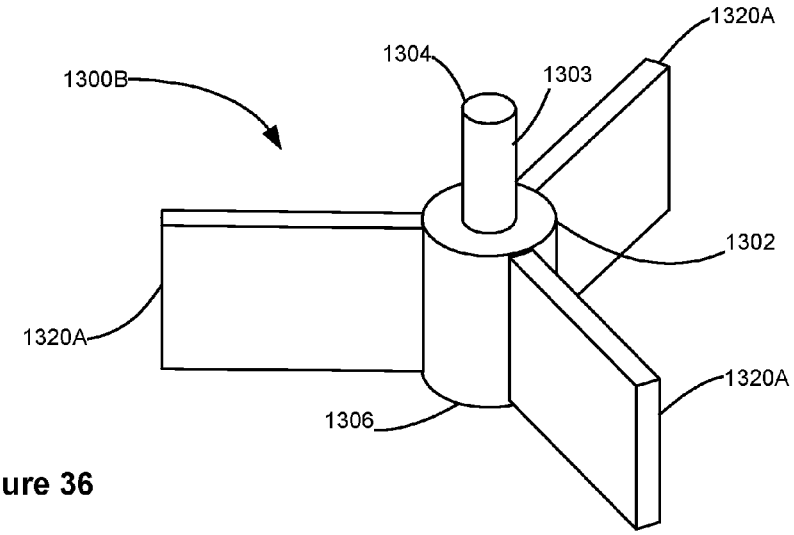

Exit paddle 1300B shown in FIG. 36 is similar in structure to exit paddle 300 having radially extending arms 1320A that extend axially along drive hub 1302. The axial width of the arms 1320A corresponds to the width of exit port 1114. The width of annular recess 1115 would be increased to accommodate the larger arms 1320A. Again, radial and axial scrapers may be attached to arms 1320A as desired.

Figure 37:
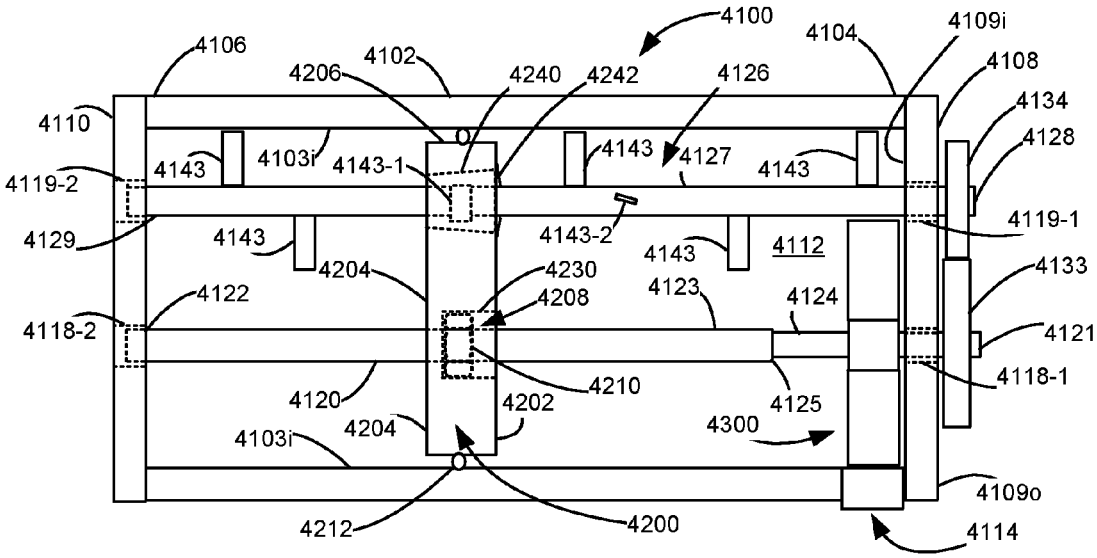
FIG. 37 is a simplified schematic illustration of a toner cartridge having an agitator assembly.

In FIG. 37, a sectional view of a toner cartridge is shown having a toner agitator assembly. To the extent possible similar numbering will be used with respect to similar elements shown in FIGS. 3-12. The toner cartridge includes a housing 4100 that is substantially the same as housing 100. Housing 4100 includes an elongated body 4102 having a first end 4104 and a second end 4106 that are enclosed by first end wall 4108 and second end wall 4110 and which collectively form a toner reservoir 4112 within housing 4100. An exit port 4114 is provided adjacent first end wall 4108 and is in fluid communication with toner reservoir 4112. Body 4102 may be of a shape as shown that bodies 102, 102A, 102B shown in FIGS. 5-7, respectively.

Aligned openings 4118-1, 4118-2 are provided in first and second end walls 4108, 4110, respectively. A drive shaft 4120 extends the length of the body 4102 with first and second ends 4121, 4122 thereof received in opening 4118-1, 4118-2, respectively. Drive shaft 4120 has a threaded portion 4123 and an unthreaded portion 4124 that meet at a junction 4125. Unthreaded portion 4124 is shown having a slightly smaller diameter than threaded portion 4123. Coupled to drive shaft 1120 are an exit paddle 4300 and a toner platform 4200 that are again substantially the same as exit paddle 300 and toner platform 200. However drive shaft 4120 and exit paddle 4300 may be of any of the configurations described previously. As shown, exit paddle 4300 is mounted on drive shaft 4120 adjacent the inner surface 4109*i* of first end wall 4108.

A drive coupler 4133 is attached to the first end 4121 of drive shaft 4120 external to first end wall 4108. Drive coupler 4133 removably engages with a drive mechanism (not shown) provided within imaging apparatus 22 to receive rotational force. The size and configuration of drive coupler 4133 is a matter of design choice and may include a gear or gear train or a coupler such as an Oldham coupler as is known in the art. Bearings or clutched bearings, as previously described, may be provided in aligned opening 4118-1, 4118-2 in end walls 4108, 4110. End walls 4108 and 4110 may be fabricated from a bearing-grade plastic obviating the need for separate bearings.

Toner platform 4200 includes a front surface 4202 that is used to push the toner within the reservoir 4112 toward the exit port 4114, a rear surface 4204, and an edge surface 4206 interconnecting the front and rear surfaces 4202, 4204. An opening 4208 is provided through toner platform 4200 for the drive shaft 4120. A coupling 4210 is mounted in or on toner platform 4200 about opening 4208 to movably couple toner platform 4200 to drive shaft 4120. As shown, coupling 4210, such as drive nut 4210, is attached to toner platform 4200 in a recess 4230 provided in front surface 4202. The other forms of attaching coupling 4210 to toner platform 4200 previously illustrated may also be used and will not be further described. An edge seal 4212 is provided on toner platform 4200. The other features previously described for toner platforms 200, 200A, and 200B may also be provided for toner platform 4200. Toner platform 4200 may also contain orienting features as shown in FIG. 7.

Figure 38:
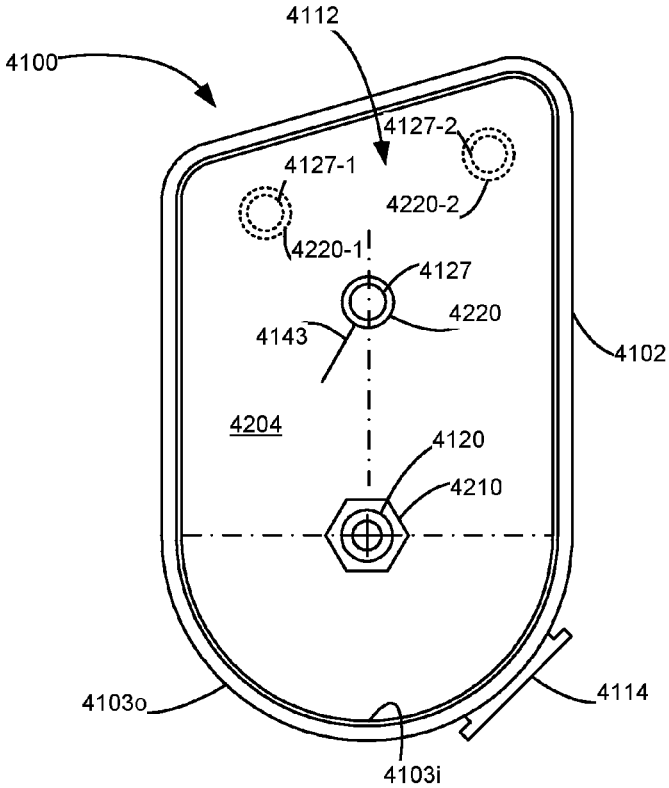
FIG. 38 is a schematic depiction of one possible body configuration for the toner cartridge of FIG. 37 illustrating the placement of multiple agitator assemblies.

An agitator assembly 4126 is provided in housing 4100. Agitator assembly 4126 comprises an agitator shaft 4127 having first and second ends 4128, 4129, respectively and one or more agitator bars or wipers 4143 mounted thereon. A second opening 4240 is provided through toner platform 4200 that as shown is above opening 4208. Second opening 4240 is aligned with openings 4119-1, 4119-2 provided in first and second end wall 4108, 4110, respectively. Rotatably received in these openings is agitator shaft 4127. First end 4128 of agitator shaft 4127 extends through first end wall 4108. Second end 4129 of drive shaft 4127 is received in opening 4119-2. An agitator drive coupling 4134 is mounted on first end 4128 of drive shaft 4127. Agitator drive coupling 4134 is shown rotatably coupled with drive coupling 4133. Agitator drive coupling 4134 may also be directly coupled to imaging apparatus 22 to receive torque. More than one agitator shaft may be provided. Agitator shaft 4127 may be vertically aligned with drive shaft 4120 as shown in FIG. 38. Also shown in FIG. 38, the agitator shaft may be radially offset from drive shaft 4120 or more than one agitator shaft may be provided. Multiple agitator shafts may also be used as shown by the agitator shafts 4127-1, 4127-2 passing through openings 4220-1, 4220-2, all shown in dashed lines, in platform 4200 to accommodate the irregular shape of the reservoir. Agitator shafts 4127-1, 4127-2 are illustrated as being radially offset from drive shaft 4120 and are vertically offset from one another. Again the number and placement of agitator shafts would be matter of design choice.

As agitator assembly 4126 is rotated by agitator drive coupling 4134, wipers or bars 4143 sweep through the upper portion of reservoir 4112 to prevent toner bridging that may occur as toner platform translates toward exit port 4114. The location of the agitator assembly 4126 in relation to drive shaft 4120 and exit paddle 4300 is a matter of design choice. In one form, the agitator assembly 4126 is located so that the wiper or bars 4143 would slidably contact the inner surface 4103*i* of body 4102 during a portion of their rotational travel.

Wiper or bars 4143 may be formed of a flexible material to allow them to pass through second opening 4240 in toner platform 4200. As shown, wiper or bar 4143-1 is wrapped around agitator shaft 4127 within opening 4240 as it passes through toner platform 200. Opening 4240 may also be flared having the larger end at front surface 4202 to ease the transition of the wiper or bars 4143 therethrough. As shown with wiper or bar 4143-2, the wipers or bars 4143 may also be mounted at an acute angle with respect to the rotational centerline of the agitator shaft 4127 to further ease their transition through toner platform 4200. Alternatively wipers or bars 4143 may be spring biased and fold into recesses provided in agitator shaft 4127 in a similar manner to stirring rod assemblies 174 (See FIG. 30). Sealing material may be provided between opening 4240 and agitator shaft 4127 to prevent toner leakage through opening 4240. As illustrated a seal 4242 is shown mounted on front surface 4202 about the end of opening 4240 and agitator shaft 4127.

As a person of skill in the art would recognize, the retention devices, thread followers, seals, and frangible portions previously described may also be employed with housing 4100, toner platform 4200 and/or drive shaft 4120. Drive shaft 4120 may also be provided with one or more stirring rod assemblies 174 as desired. An end cap including a handle, as previously described, may be provided at second end 4106 of body 4102. A vent hole as previously described may also be provided in end walls 4108, 4110 or body 1102. Keying features, previously described, may be provided on first end wall 4108. The attachment of first and second end walls 4108, 4110 to body may be made by any of the means previously described. Further, one the end walls 4108, 4110 may be integrally formed with the body 4102.

For all of the various toner cartridge configurations shown, the toner cartridge 35 may be oriented within the imaging apparatus 22 horizontally, vertically or at any angle therebetween. Further the location of the exit port 114 may be moved from the body 102 into the first end wall 108 to accommodate the orientation that is used for the toner cartridge 35.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A toner cartridge for an electrophotographic imaging device, comprising:

a housing comprising two opposed end walls, an elongated body therebetween and an exit port, the body having an inner surface defining a toner reservoir for containing a quantity of toner, the toner reservoir in fluid communication with the exit port;

a drive shaft rotatably mounted within the toner reservoir;

a toner platform having a front surface, a rear surface and an edge surface, the front surface for moving toner within the reservoir toward the exit port, the toner platform in slidable contact with the inner surface and movably coupled to the drive shaft, the toner platform being nonrotatable relative to the housing; and a resilient arm positioned within the reservoir and biased toward an initial position in the path of the toner platform, wherein when the drive shaft rotates the toner platform translates toward the exit port for moving toner within the reservoir toward the exit port, when the toner platform contacts the resilient arm the resilient arm moves out of the path of the toner platform to permit the toner platform to pass and when the toner platform moves further toward the exit port the resilient arm returns to the initial position.

2. The toner cartridge of claim 1 wherein the resilient arm is mounted on the inner surface and the inner surface has a recess positioned to receive the resilient arm when the toner platform contacts the resilient arm.

3. The toner cartridge of claim 1 wherein the resilient arm is mounted on the toner platform and the inner surface has a recess positioned to receive the resilient arm when the toner platform contacts the resilient arm.

4. The toner cartridge of claim 1 wherein the resilient arm is mounted on the drive shaft and the drive shaft includes a recess positioned to receive the resilient arm when the toner platform contacts the resilient arm.

5. The toner cartridge of claim 4 wherein the resilient arm is pivotally mounted in the recess of the drive shaft and cantilevered outward from the drive shaft in the initial position.

6. The toner cartridge of claim 1 wherein the resilient arm is cantilevered into the path of the toner platform.

7. A toner cartridge for an electrophotographic imaging device, comprising:

a housing comprising two opposed end walls and an elongated body therebetween, the body having an outer wall and an inner wall, the inner wall and the two opposed end walls defining a reservoir within the body, the reservoir having a volume for containing toner, the reservoir in fluid communication with an exit port in the housing for delivering toner from the reservoir, the exit port positioned adjacent to an end of the housing;

a drive shaft rotatably supported by the opposed end walls, the drive shaft having a threaded portion and an unthreaded portion having a junction therebetween, one end of the drive shaft extending through one of the end walls for receiving torque;

a toner platform for moving toner within the reservoir and shaped to conform to the cross-sectional shape of the reservoir;

a coupling attached to the toner platform and threadably and rotatably connected with the threaded portion of the drive shaft;

an exit paddle mounted on the drive shaft at the exit port; and a resilient arm positioned within the reservoir and biased toward an initial position in the path of the toner platform, wherein when the drive shaft rotates the toner platform translates within the reservoir toward the exit port for moving toner within the reservoir toward the exit port and when the drive shaft rotates the exit paddle rotates for delivering toner out of the exit port, wherein when the toner platform contacts the resilient arm the resilient arm moves out of the path of the toner platform to permit the toner platform to pass and when the toner platform moves further toward the exit port the resilient arm returns to the initial position.

8. The toner cartridge of claim 7 wherein the resilient arm is mounted on the inner wall and the inner wall has a recess positioned to receive the resilient arm when the toner platform contacts the resilient arm.

9. The toner cartridge of claim 7 wherein the resilient arm is mounted on the toner platform and the inner wall has a recess positioned to receive the resilient arm when the toner platform contacts the resilient arm.

10. The toner cartridge of claim 7 wherein the resilient arm is mounted on the drive shaft and the drive shaft includes a recess positioned to receive the resilient arm when the toner platform contacts the resilient arm.

11. The toner cartridge of claim 10 wherein the resilient arm is pivotally mounted in the recess of the drive shaft and cantilevered outward from the drive shaft in the initial position.

12. The toner cartridge of claim 7 wherein the resilient arm is cantilevered into the path of the toner platform.

13. A toner cartridge for an electrophotographic imaging device, comprising:

a housing comprising two opposed end walls, an elongated body therebetween and an exit port, the body having an inner surface defining a toner reservoir for containing a quantity of toner, the toner reservoir in fluid communication with the exit port; the inner surface having a recess therein at a predetermined position with the reservoir, the recess sized to receive a portion of the toner platform;

a drive shaft rotatably mounted within the toner reservoir, the drive shaft rotatable in a first direction and a second direction that is opposite the first direction; and a toner platform having a front surface, a rear surface and an edge surface, the front surface for moving toner within the reservoir toward the exit port, the toner platform in slidable contact with the inner surface and movably coupled to the drive shaft, the toner platform being nonrotatable relative to the housing;

wherein when the drive shaft rotates in the first direction the toner platform translates toward the exit paddle for moving toner within the reservoir toward the exit port and when the toner platform is aligned with the recess and the drive shaft rotates in the second direction, the toner platform rotates into the recess.

14. The toner cartridge of claim 13 wherein the reservoir has an upper portion having a cuboid shape and a lower portion having a semi-cylindrical shape and the toner platform has an upper portion having a rectangular shape corresponding to the cross section of the upper portion of the reservoir and a lower portion having a semi-circular shape corresponding to the cross section of the lower portion of the reservoir.

15. The toner cartridge of claim 13 wherein the reservoir has an upper portion having a trapezium shape and a lower portion having a semi-cylindrical shape and the toner platform has an upper portion having a trapezoidal shape corresponding to the cross section of the upper portion of the reservoir and a lower portion having a semi-circular shape corresponding to the cross section of the lower portion of the reservoir.

16. The toner cartridge of claim 13 further comprising a circumferential edge seal positioned on the edge surface of the toner platform, the edge seal providing a slidable sealing contact between the toner platform and the inner surface of the body.

17. The toner cartridge of claim 13 further comprising an exit paddle positioned in the reservoir adjacent the exit port and rotatable by the drive shaft, wherein the drive shaft has a threaded portion and an unthreaded portion having a junction therebetween wherein the length of the unthreaded portion is at least equal to the distance from the junction of the drive shaft to the end wall closest to the exit paddle less the width of the exit paddle with the predetermined position of the recess in the inner surface being aligned with the junction.

18. The toner cartridge of claim 17 wherein the toner platform further comprises a planar front surface and oriented substantially parallel to one of the first and second end walls, the edge surface of the toner platform having a circumferential edge seal mounted thereon in slidable sealing contact with the inner surface of the body, the toner platform being non-rotatable relative to the housing and having an opening therethrough for receiving the drive shaft, the thickness of the toner platform being equal to or less than the length of the unthreaded portion of the drive shaft.

* * * * *